US007212648B2

(12) United States Patent
Saiki et al.

(10) Patent No.: US 7,212,648 B2
(45) **Date of Patent: *May 1, 2007**

(54) LOUDSPEAKER SYSTEM IN WHICH A DIAPHRAGM PANEL IS DRIVEN BY AN ELECTROMECHANICAL ACOUSTIC CONVERTER

(75) Inventors: Shuji Saiki, Uda-gun (JP); Sawako Usuki, Kobe (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 661 days.

This patent is subject to a terminal disclaimer.

(21) Appl. No.: 10/384,554

(22) Filed: Mar. 11, 2003

(65) Prior Publication Data

US 2003/0174849 A1 Sep. 18, 2003

(30) Foreign Application Priority Data

Mar. 15, 2002 (JP) ..... 2002-071863

(51) Int. Cl.
*H04R 1/02* (2006.01)

(52) U.S. Cl. ..... 381/423; 381/431

(58) Field of Classification Search ..... 381/150, 381/152, 182, 184, 345, 349, 350, 351, 396, 381/398, 423; 181/148, 164, 183
See application file for complete search history.

(56) References Cited

U.S. PATENT DOCUMENTS

| | | | | |
|---|---|---|---|---|
| 2,713,396 | A | 7/1955 | Tavares | |
| 3,164,221 | A | 1/1965 | Rich | |
| 6,021,208 | A | 2/2000 | Kin-Lung | |
| 6,199,655 | B1 | 3/2001 | Norris | |
| 6,389,146 | B1 * | 5/2002 | Croft, III | 381/345 |
| 2001/0026625 | A1 * | 10/2001 | Azima et al. | 381/152 |
| 2002/0061114 | A1 * | 5/2002 | Croft, III | 381/351 |

FOREIGN PATENT DOCUMENTS

| | | |
|---|---|---|
| EP | 0 284 051 | 9/1988 |
| EP | 1 107 641 | 6/2001 |
| EP | 1 137 317 | 9/2001 |
| JP | 55-46376 | 9/1953 |
| JP | 57-168386 | 4/1956 |
| JP | 62-186584 | 11/1987 |
| JP | H1-159487 | * 4/1988 |
| JP | 2-202295 | 8/1990 |
| JP | 09-307996 | 11/1997 |
| JP | 11-512260 | 10/1999 |
| JP | 2001-112076 | 4/2001 |
| JP | 2002-533957 | 10/2002 |
| WO | 00/02417 | 1/2000 |

* cited by examiner

*Primary Examiner*—Sinh Tran
*Assistant Examiner*—Brian Ensey
(74) *Attorney, Agent, or Firm*—Wenderoth, Lind & Ponack, L.L.P.

(57) ABSTRACT

A sound-driving loudspeaker system is achieved with a simple structure and is capable of easily improving acoustic characteristics. The loudspeaker system emits sound by driving a diaphragm panel by an electromechanical acoustic transducer. The loudspeaker system includes a board, the diaphragm panel whose rim is fixedly attached to the board so as to form a space and which has a stiffness lower than that of the board, and the electromechanical acoustic transducer for emitting sound into the space. With this structure, the diaphragm panel is flexed to be vibrated by the sound emitted from the electromechanical acoustic transducer.

6 Claims, 21 Drawing Sheets

LOUDSPEAKER SYSTEM IN WHICH A DIAPHRAGM PANEL IS DRIVEN BY AN ELECTROMECHANICAL ACOUSTIC CONVERTER

BACKGROUND OF THE INVENTION

1. Field of the Invention

The present invention relates to a loudspeaker system and, more specifically, to a loudspeaker system in which a diaphragm panel is driven by an electromechanical acoustic transducer.

2. Description of the Background Art

Loudspeaker systems in which a diaphragm panel is driven by an electromechanical acoustic transducer have been suggested. One exemplary loudspeaker system employs a scheme in which an electromechanical transducer is directly attached to a diaphragm panel. In another example, a scheme is employed in which a diaphragm panel is acoustically vibrated by an electromechanical acoustic transducer via a space (such a scheme is hereinafter referred to as a sound-driving scheme). Here, the scheme in which the electromechanical transducer is directly attached to the diaphragm panel has several drawbacks. For example, in order to achieve required acoustic characteristics, there is a limitation of the location of the diaphragm panel to which the electromechanical transducer is attached. Therefore, in view of design flexibility of the loudspeaker system, the sound-driving scheme is more advantageous.

FIG. 14 is an illustration showing a basic configuration of a conventional loudspeaker system using the sound-driving scheme. In FIG. 14, 100 denotes a plate-like diaphragm panel. 101 denotes a suspension for supporting the outer rim of the diaphragm panel 100. 102 denotes a frame for fixing the outer rim of the suspension. 103 denotes an acoustic aperture provided on the bottom of the frame 102. 104 denotes an electromechanical acoustic transducer such as to cover the acoustic aperture 103. 105 denotes an enclosed space formed between the diaphragm panel 100 and the electromechanical acoustic transducer 104. In this loudspeaker system, the suspension 101 for supporting the outer rim of the diaphragm panel 100 causes the entire diaphragm panel 100 to perform a piston action for emitting sound. That is, sound emitted from the electromechanical acoustic transducer 104 is led to the enclosed space 105, where air is pressurized to cause the diaphragm panel 100 to vibrate, thereby emitting sound.

It is assumed herein that the diaphragm panel 100 performs a piston action in any frequency band. Under this assumption, an equivalent circuit of the loudspeaker system illustrated in FIG. 14 can be presented as illustrated in FIG. 15. In the equivalent circuit illustrated in FIG. 15, F denotes a driving force of the electromechanical acoustic transducer 104 (driver). Rme denotes a magnetic damping resistance. Cms denotes a compliance of components that support vibrating components of the driver. Mms denotes a mass of the vibrating components in the driver. Rms denotes a mechanical resistance associated with the supporting of the driver. Sd denotes an effective area of a diaphragm of the driver. Furthermore, Cab denotes an acoustic compliance of the enclosed space 105. Rab denotes an acoustic resistance of the enclosed space 105. Cmp denotes a compliance of the suspension 101. Rmp denotes a mechanical resistance of the suspension 101. Mmp denotes a mass of the diaphragm panel 100. Sp denotes an effective vibration area of a diaphragm portion composed of the diaphragm panel 100 and the suspension 101.

As can be known from the equivalent circuit illustrated in FIG. 15, an acoustic transformer is structured based on an area ratio of the effective area Sd of the diaphragm of the electromechanical acoustic transducer 104 with respect to the effective vibration area Sp of the diaphragm portion (Sd/Sp). Therefore, at the time of the operation of the loudspeaker system, an equivalent mass of the diaphragm portion with respect to the electromechanical acoustic transducer 104 is proportional to the square of the area ratio (Sd/Sp). Therefore, if an electromechanical acoustic transducer having a diaphragm area smaller than the diaphragm panel 100 is used, the equivalent mass of the diaphragm panel 100 is small. In this case, even if the diaphragm panel 100 having a large mass is used, the efficiency of the loudspeaker system itself is not degraded.

In the loudspeaker system illustrated in FIG. 14, if a height Tg of the enclosed space 105 is lowered, a reproduction limit frequency in the treble range can be increased. Here, the reproduction-limit frequency in the treble range is defined by the mass Mmp of the diaphragm panel 100 and the acoustic compliance Cab of the enclosed space 105. Also, the acoustic compliance Cab is defined by the capacity and height Tg of the enclosed space 105. Therefore, in order to increase the reproduction-limit frequency in the treble range, the height Tg is lowered, thereby decreasing the acoustic compliance Cab.

FIG. 16 is a graph showing sound pressure frequency characteristics predicted by the equivalent circuit illustrated in FIG. 15. In FIG. 16, the illustrated characteristics can be predicted when the height Tg of the enclosed space 105 is 0.2 (mm), 0.4 (mm), or 0.8 (mm). Conditions for the above prediction are as follows. That is, an electrodynamic loudspeaker whose effective diaphragm area is approximately ϕ16 (mm) in diameter is used as the electromechanical acoustic transducer 104. Also, a plate of 72 (mm) in height× 51 (mm) in width×1 (mm) in thickness made of polycarbonate is used as the diaphragm panel 100. The suspension 101 for use is made of SBR (styrene-butadiene rubber) of 5 (mm) in width×50 (μm) in thickness. As evident from FIG. 16, since the reproduction limit frequency in the treble range is defined by the height Tg of the enclosed space 105, the height Tg has to be lowered in order to increase the reproduction limit frequency in the treble range.

In the above-mentioned conventional loudspeaker system using the sound-driving scheme, a suspension for supporting the outer rim of the diaphragm panel is required. This requirement makes the configuration of the loudspeaker system complicated. Furthermore, the complicated configuration makes it difficult to reduce the size of the loudspeaker system. Therefore, it is difficult to use the conventional loudspeaker system in devices such as portable terminals, which require downsizing and space-savings.

Furthermore, in the conventional loudspeaker system using the sound-driving scheme, it is difficult to improve acoustic characteristics in the bass and treble ranges simultaneously. That is, in the conventional scheme of driving the diaphragm panel by a piston action, the diaphragm panel is required to be high in stiffness and light in weight. However, there is a limitation in order to simultaneously satisfy both of high stiffness and light weight for achieving improvements in the acoustic characteristics. Details are described below.

Descriptions are made below to the fact that lowering the stiffness of the diaphragm panel reduces the sound pressure level. FIGS. 17 and 18 are illustrations showing the results obtained by measuring the characteristics of the loudspeaker system under the same conditions as those of FIG. 16. FIG.

17 is an illustration showing a vibration mode of the diaphragm panel of the conventional loudspeaker system at a frequency of 500 (Hz). FIG. 18 is a graph showing sound pressure frequency characteristics of the conventional loudspeaker system. In FIG. 17, the height Tg of the enclosed space 105 is 0.2 (mm).

FIG. 17 illustrates a vibration mode of the suspension 101 on which the outer rim of the diaphragm panel 100 is mounted. Here, white portions represent a large vibration. As evident from FIG. 17, most of the suspension 101 is greatly vibrated. On the other hand, the diaphragm panel 100 has the outer rim portion being greatly vibrated, and a center portion being slightly vibrated. Therefore, in a bass range at a frequency of 500 (Hz), a separated resonance occurs, that is, the outer rim of the diaphragm panel 100 is greatly vibrated. In other words, in FIG. 17, the diaphragm panel 100 does not perform a piston action, that is, the diaphragm panel is vibrated not as a whole. This is because the stiffness of the diaphragm panel 100 is low. This also means that the equivalent circuit illustrated in FIG. 15 is not applicable. As illustrated in FIG. 18, in practice, the separated resonance in the bass range occurring at the diaphragm panel 100 causes an increase of an acoustic impedance, that is, an acoustic load applied to the diaphragm. As a result, the velocity of the diaphragm is decreased, and the sound pressure level is also decreased. In FIG. 18, a solid line denotes actual measured values of the sound pressure frequency characteristics, while a dotted line denotes predicted values obtained by the equivalent circuit illustrated in FIG. 15. In FIG. 18, the sound pressure level of the measured values is lower than that of the values obtained by the equivalent circuit by approximately 10 (dB).

As described above, when the stiffness of the diaphragm panel is low, the sound pressure level in the bass range is also reduced. In order to solve this problem, the diaphragm panel requires a stiffness to some extent. One way to increase the stiffness of the diaphragm panel is, for example, to configure the diaphragm panel 100 so as to have a sandwich structure, that is, a structure with a core material sandwiched between surface materials attached thereto. Such a sandwich structure of the diaphragm panel 100, however, has several drawbacks. Particularly, the use of the surface materials increases the mass of the diaphragm panel 100, thereby disadvantageously lowering the sound pressure level in the treble range. Furthermore, the sandwich structure of the diaphragm panel 100 is rather a complicated structure, and also increases the thickness of the diaphragm panel 100.

As such, in the conventional sound-driving scheme of causing the entire diaphragm panel 100 to perform a piston action, the stiffness of the diaphragm panel 100 has to be increased in order to improve the sound pressure level in the bass range. In order to improve the treble sound pressure level, on the other hand, the weight of the diaphragm panel 100 has to be reduced. In practice, however, in view of the structure and material of the diaphragm panel, there is a limitation to simultaneous achievement of high stiffness and light weight. Therefore, in the conventional sound-driving scheme, it is difficult to simultaneously achieve improvement in the acoustic characteristics in both the bass and treble ranges.

SUMMARY OF THE INVENTION

Therefore, an object of the present invention is to provide a sound-driving loudspeaker system achievable with a simple configuration.

Another object of the present invention is to provide a sound-driving loudspeaker system capable of easily improving acoustic characteristics.

The present invention has the following features to attain the objects mentioned above. That is, the loudspeaker system according to the present invention includes a board, an electromechanical acoustic transducer, and a diaphragm panel. The board forms a space for sound emission. The electromechanical acoustic transducer is connected to the board for emitting sound into the space for sound emission. The diaphragm panel has an outer rim portion fixed to the board in a manner to form the space with the board and has a stiffness lower than a stiffness of the board. Also, the diaphragm panel is flexed to be vibrated by energy of the sound emitted from the electromechanical acoustic transducer into the space to externally output the sound.

According to the above, the stiffness of the diaphragm panel is lower than that of the board. Therefore, when sound is emitted into the space, the diaphragm panel is flexed to be vibrated, thereby emitting sound. As such, when the diaphragm panel is vibrated by flex, the diaphragm panel can be directly attached to the board without a suspension, for example, for supporting the rim of the diaphragm panel. Thus, the configuration of the loudspeaker system can be simplified. With this, it is possible to achieve a small-sized, space-saving loudspeaker system.

Furthermore, according to the above, the entire diaphragm panel is vibrated not by a piston action but by flex. In this flex vibration scheme, for the purpose of improving a sound pressure level, the diaphragm panel is made to have a low stiffness and a light weight. Therefore, the sound pressure level in the bass range can be easily improved. That is, with the configuration of the loudspeaker system according to the present invention, the sound pressure level in the bass range can be easily improved.

Still further, the diaphragm panel may be made of a transparent material. Also, the board may be made of a transparent material. With this, the diaphragm panel can be made visually unobtrusive. Especially, the loudspeaker system according to the present invention can be achieved with a simple configuration without requiring a suspension. Therefore, with the diaphragm panel and the board being made transparent, a visually unobtrusive loudspeaker system can be easily achieved.

Still further, the loudspeaker system further includes light-emitting means. The light-emitting means is mounted onto the board and/or the diaphragm panel, for emitting light in response to an input signal supplied to the electromechanical acoustic transducer. The light-emitting means is implemented by a light-emitting diode, for example, but can be any light emitting device as long as it emits light in response to an electrical signal. With this, a loudspeaker system that can provide visual enjoyment to users can be achieved.

Still further, the diaphragm panel has an outer rim portion fixed to the board via a spacer. Here, the board may be a member dedicated to the loudspeaker system, or may be the entire or part of a structural component different from that of the loudspeaker system. That is, the board may serve as a structural component other than that of the loudspeaker system. The structural component is a concept including, for example, a wall of a building, a glass surface of a show window, a vehicle body, etc. If a poster pasted on a wall is used as the diaphragm panel, for example, it is possible to achieve a loudspeaker system that emits sound from the poster on the wall. Also, if a picture is pasted on a wall and a transparent diaphragm panel is placed on the picture, it is possible to achieve a loudspeaker system capable of providing users with a feeling as if the picture on the wall itself emits sound. Furthermore, with the use of a transparent diaphragm panel and a glass window as the board, for example, it is possible to achieve a loudspeaker system allowing users to see an outside view through the board and the transparent panel.

Still further, the board may have an acoustic aperture. In this case, the electromechanical acoustic transducer is positioned opposed to the diaphragm panel to allow sound to be emitted from the acoustic aperture into the space. This can achieve a configuration in which sound emitted from the electromechanical acoustic transducer is led to the space at the back of the diaphragm panel.

Still further, the loudspeaker system may further include an acoustic pipe for connecting the board and the electromechanical acoustic transducer together. In this case, the board has an acoustic aperture at a portion connected to the acoustic pipe. Also, the electromechanical acoustic transducer emits sound from the acoustic aperture through the acoustic pipe into the space. With this, the electromechanical acoustic transducer can be freely placed separately from the board and the diaphragm panel. Since the electromechanical acoustic transducer can be placed anywhere, design flexibility of the loudspeaker system is increased. It is particularly advantageous to place the electromechanical acoustic transducer, which is very difficult to be made transparent, separately from the diaphragm panel and the board both made transparent, thereby achieving a loudspeaker system with visually unobtrusive diaphragm panel and board.

Still further, the loudspeaker system further includes a cabinet for forming an enclosed space at the back of the electromechanical acoustic transducer. With this, sound of opposite phase from the back of the electromechanical acoustic transducer can be shielded. Therefore, a loudspeaker system excellent in reproduction of sound in the bass range can be achieved.

These and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1A:
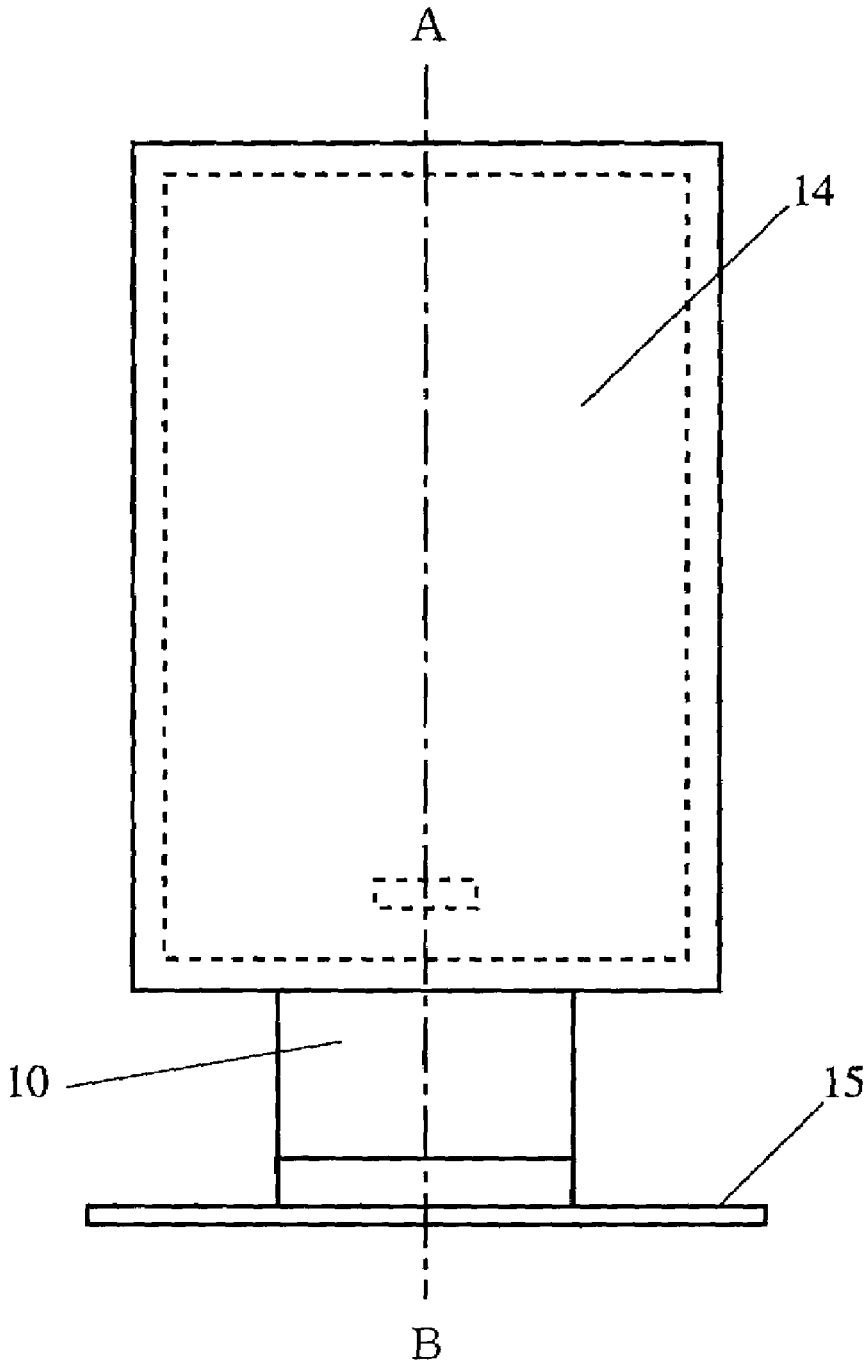
FIGS. 1A and 1B are illustrations each showing the configuration of a loudspeaker system according to Embodiment 1.
Figure 1B:
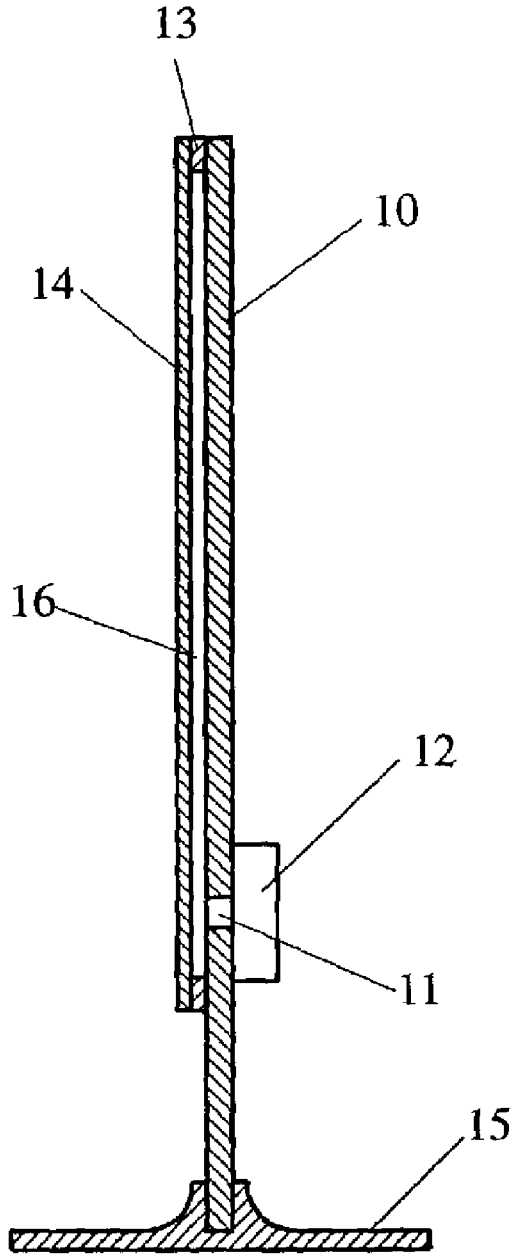
Figure 2:
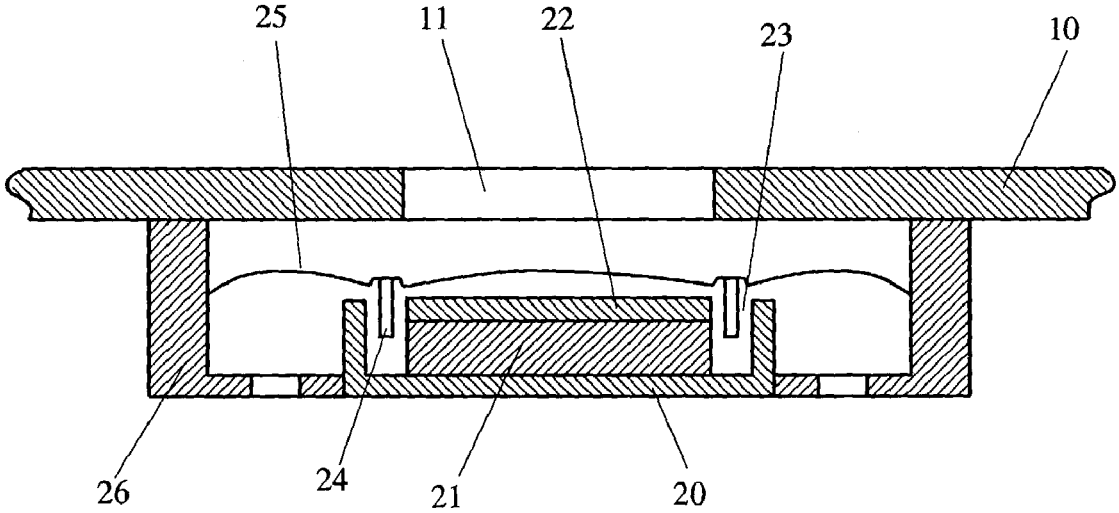
FIG. 2 is a section view of an electrodynamic loudspeaker, which is one example of an electromechanical acoustic transducer 12 illustrated in FIG. 1B.
Figure 10:
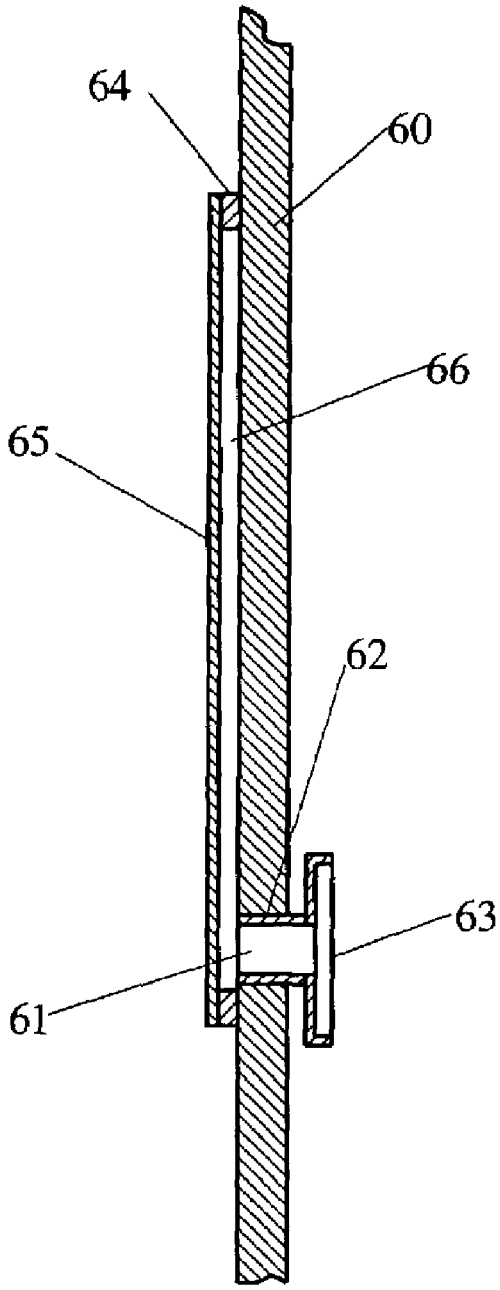
FIG. 10 is an illustration showing the configuration of a loudspeaker system according to Embodiment 4 of the present invention.

The configuration of a loudspeaker system according to Embodiment 1 of the present invention is now described by using FIGS. 1A, 1B, and 2. FIGS. 1A and 1B are illustrations each showing the configuration of the loudspeaker system according to Embodiment 1. Here, FIG. 1A is a front view of the loudspeaker system. FIG. 1B is a view the loudspeaker denoted by a line A–B in FIG. 1A. In FIG. 1A, 10 denotes a board. 11 denotes a rectangular acoustic aperture provided onto the board 10. 12 denotes an electromechanical acoustic transducer attached to the board 10 so as to cover the acoustic aperture 11. 13 denotes a spacer provided on the rim of the board 10. 14 denotes a diaphragm panel whose rim is attached to the spacer 13. 15 is a base for supporting the board 10.

In Embodiment 1, the board 10 and the diaphragm panel 14 are made of a transparent material. The board 10 and the spacer 13 are also made of a transparent material such as glass, polycarbonate, or acrylic. The diaphragm panel 14 is made of a transparent material such as PET (polyethylene terephthalate). Here, the diaphragm panel 14 is selected so as to have a stiffness lower than that of the board 10. In Embodiment 1, the diaphragm panel 14 is configured to have a film shape. Also, the spacer 13 serves as a joint for jointing the board 10 and an outer rim portion of the diaphragm panel 14 together. As such, with the board 10 and the outer rim portion of the diaphragm panel 14 fixed together via the spacer 13, a space 16 is formed between the board 10 and a center portion of the diaphragm panel 14. Into the space 16, sound is emitted from the electromechanical acoustic transducer 12. The space 16 is preferably an enclosed space, but this is not meant to be restrictive.

As described above, the loudspeaker system illustrated in FIGS. 1A and 1B has a structure in which a suspension conventionally used for vibrating the diaphragm panel 14 is not used. Therefore, the structure of the conventional loudspeaker system can be simplified.

FIG. 2 is a section view of an electrodynamic loudspeaker, which is one example of the electromechanical acoustic transducer 12 illustrated in FIG. 1B. In FIG. 2, 20 denotes a vase-shaped yoke. 21 denotes a magnet provided at the center of the yoke 20. 22 denotes a plate attached to the upper surface of the magnet 21. 23 denotes a magnetic space formed between the inner rim of the yoke 23 and the outer rim of the plate 22. 26 denotes a loudspeaker frame whose center portion is attached with the outer rim of a bottom surface of the yoke 20. 25 denotes a diaphragm whose outer rim is attached to the loud speaker frame 26. 24 denotes a voice coil 24 jointed to the center portion of the diaphragm 25 so as to be located in the magnetic space 23. Also, the loudspeaker frame 26 is attached to the board 10 so that the electromechanical acoustic transducer 12 covers the acoustic aperture 11. The electromechanical acoustic transducer 12 is positioned opposed to the diaphragm panel 14 with respect to the board 10. In Embodiment 1, the electromechanical acoustic transducer 12 is connected directly to the board 10. Alternatively, the electromechanical acoustic transducer 12 can be connected to the frame 26 via an acoustic pipe, which is described further below.

The operation of the above-structured loudspeaker system is described below. An electrical signal is applied to the voice coil 24 placed within the magnetic space 23 of the electromechanical acoustic transducer 12 to drive the voice coil 24. This causes the diaphragm 25 to vibrate, thereby producing sound. The electromechanical acoustic transducer 12 emits the produced sound into the space 16. Specifically, the sound emitted from the diaphragm 25 is propagated from the acoustic aperture 11 to the space 16. Of the board 10 and the diaphragm panel 14 that form the space 16, it is the diaphragm panel 14 that has a lower stiffness. Therefore, it is the diaphragm panel 14 that vibrates by energy (sound pressure) of the sound emitted from the electromechanical acoustic transducer 12 to the space 16. That is, the diaphragm panel 14 is acoustically driven by the electromechanical acoustic transducer 12 to vibrate. Since the outer rim portion of the diaphragm panel 14 is fixed to the board 10 with the spacer 13, the structural strength of the outer rim portion of the diaphragm panel 14 is higher than the structural strength of the center portion thereof. Therefore, the center portion of the diaphragm panel 14 vibrates to produce sound. With this vibration, the loudspeaker system emits sound outside for sound reproduction.

Figure 3:
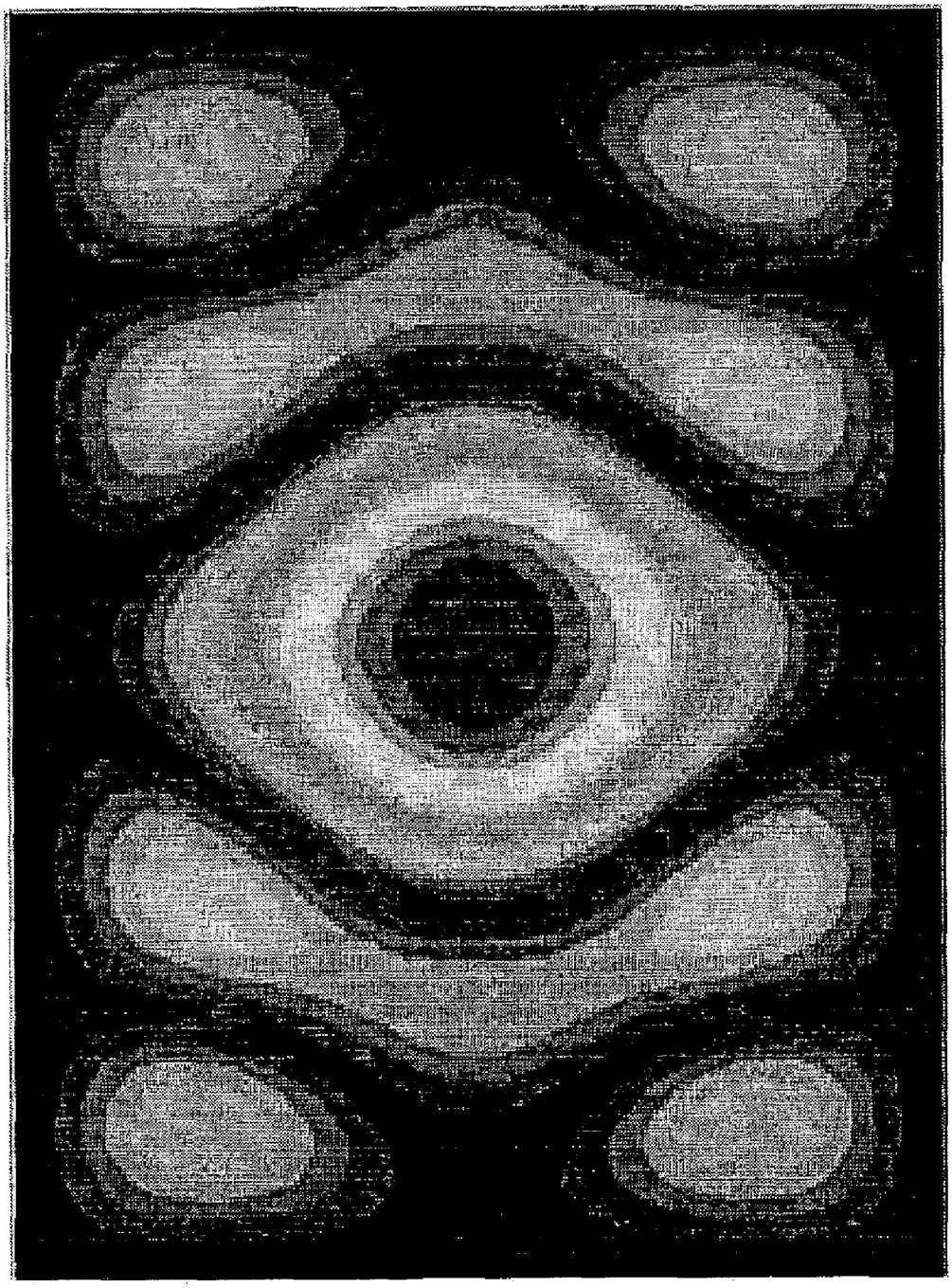
FIG. 3 is an illustration showing a vibration mode of a diaphragm panel of the loudspeaker system according to Embodiment 1.
Figure 17:
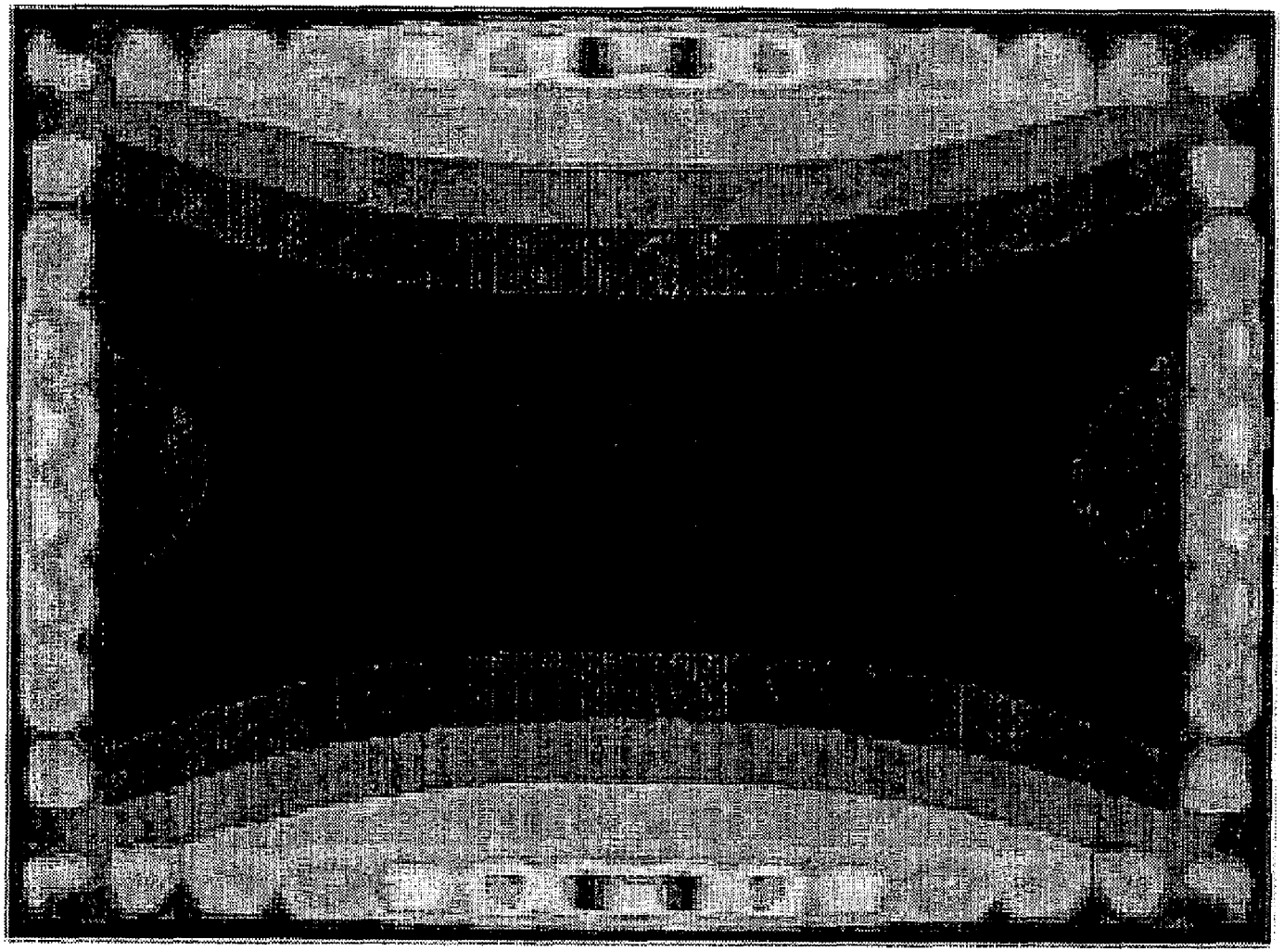
FIG. 17 PRIOR ART
FIG. 17 is an illustration showing a vibration mode of a diaphragm panel of a conventional loudspeaker system at a frequency of 500 (Hz)

The characteristics of the loudspeaker system according to Embodiment 1 are described below with reference to FIGS. 3 and 4. FIG. 3 is an illustration showing a vibration mode of the diaphragm panel 14 of the loudspeaker system according to Embodiment 1. Here, the vibration mode illustrated in FIG. 3 is at a frequency of 500 (Hz). The vibration mode illustrated in FIG. 3 is complicated compared with the vibration mode illustrated in FIG. 17, with the sheet-like diaphragm panel 14 being flexed like a wave. As such, in the present invention, the diaphragm panel 14 is flexed to vibrate, unlike a case in which the entire diaphragm panel 14 vibrates like a piston movement. The diaphragm panel 14 is preferably bendable, and is therefore preferably light in weight and low in stiffness. Furthermore, for vibration, the diaphragm panel 14 should be lower in stiffness than the board 10.

Figure 4:
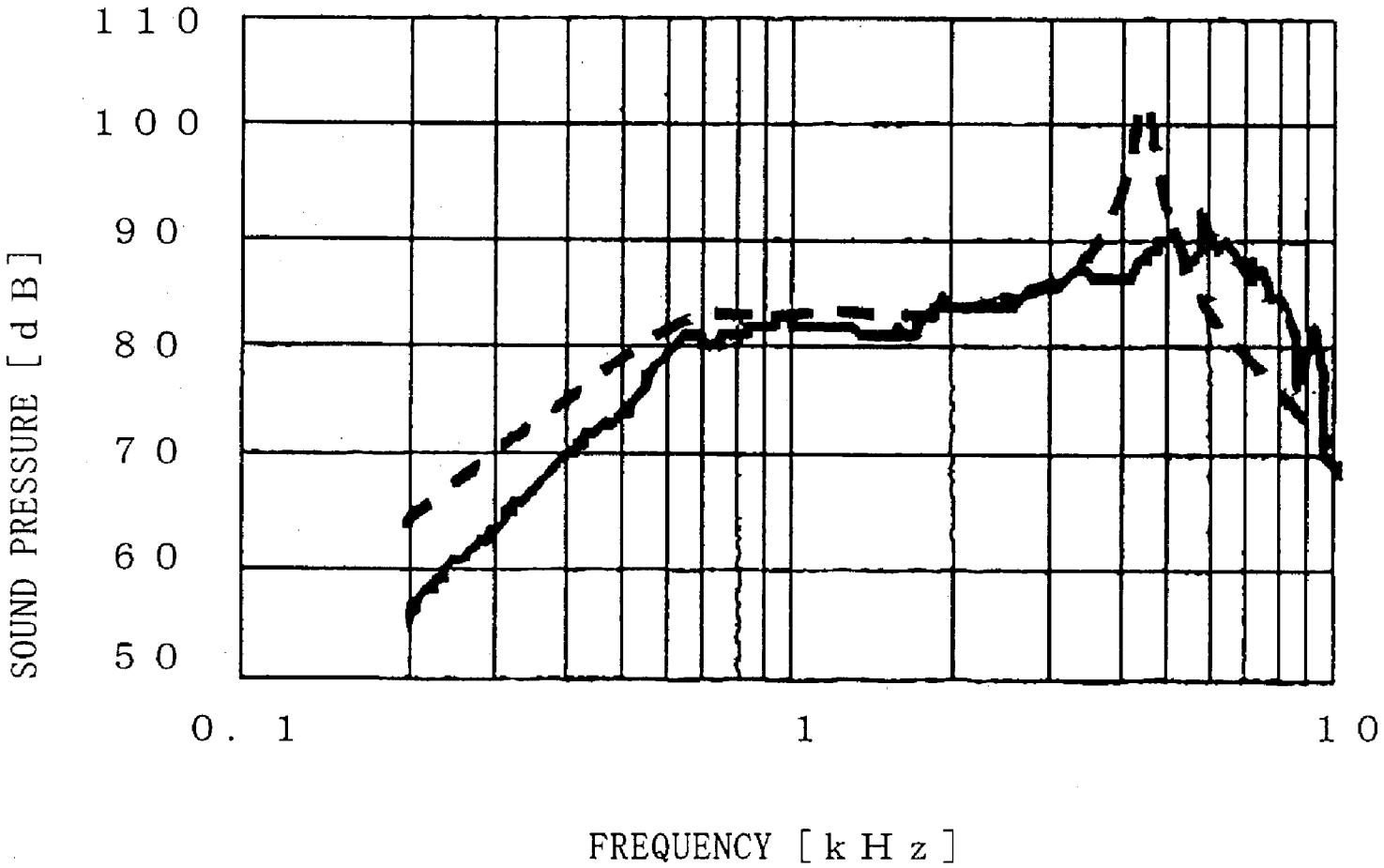
FIG. 4 is an illustration showing sound pressure frequency characteristics of the loudspeaker system according to Embodiment 1.
Figure 15:
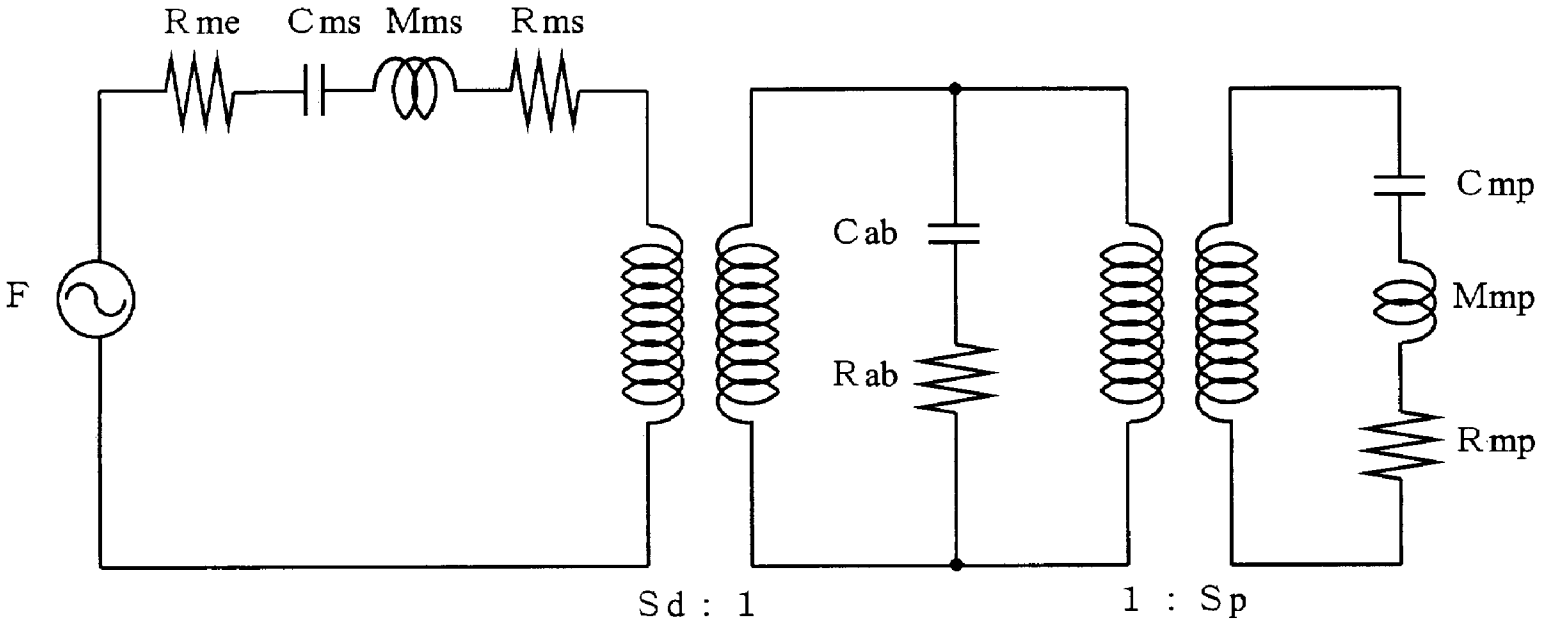
FIG. 15 PRIOR ART
FIG. 15 is an illustration showing an equivalent circuit of the loudspeaker system illustrated in FIG. 14.
Figure 16:
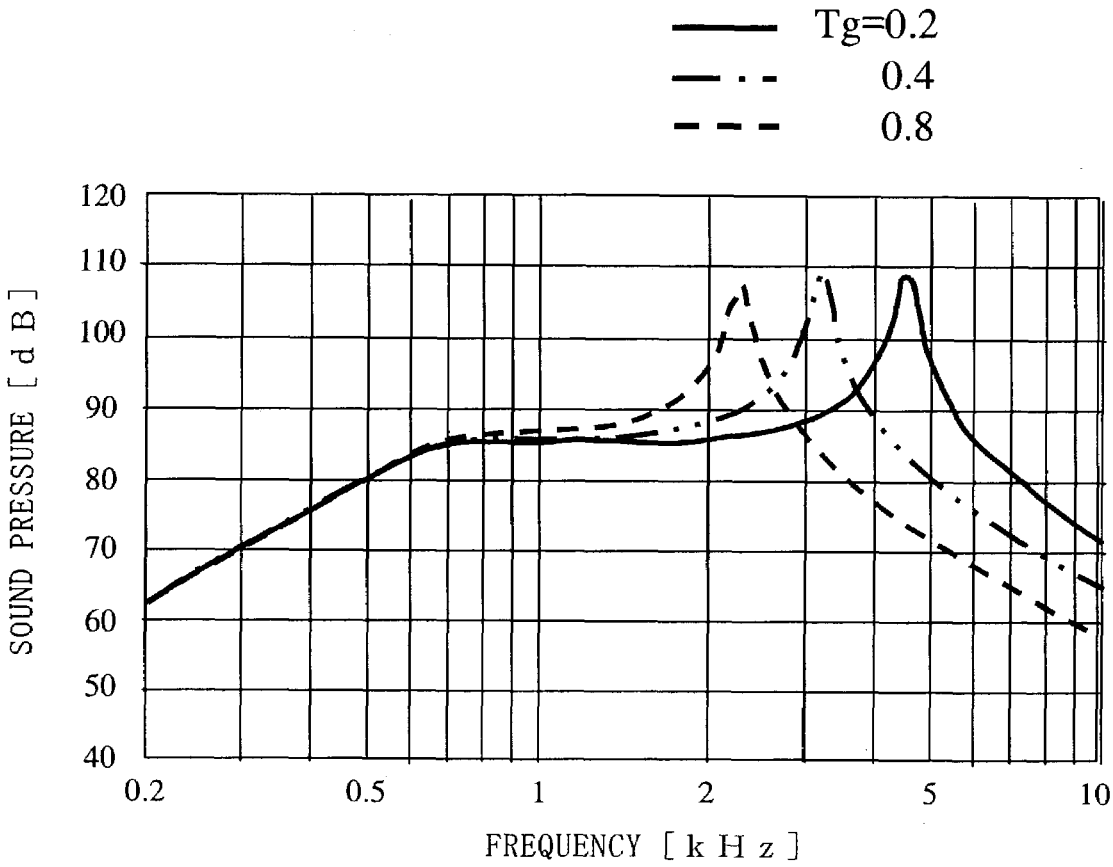
FIG. 16 PRIOR ART
FIG. 16 is a graph showing sound pressure frequency characteristics predicted by the equivalent circuit illustrated in FIG. 15.
Figure 18:
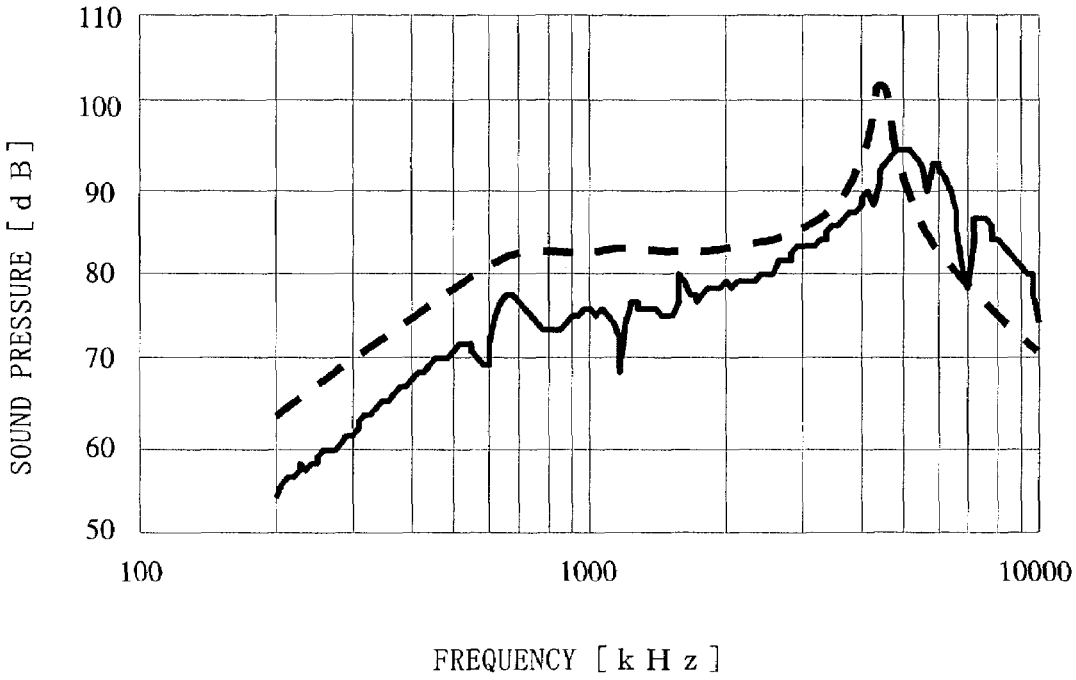
FIG. 18 PRIOR ART
FIG. 18 is a graph showing sound pressure frequency characteristics of the conventional loudspeaker system.

FIG. 4 is an illustration showing sound pressure frequency characteristics of the loudspeaker system according to Embodiment 1. In FIG. 4, a solid line represents characteristics of a sound pressure frequency of the loudspeaker system according to Embodiment 1, while a dotted line represents predicted values by the equivalent circuit illustrated in FIG. 15 (the same as the dotted line illustrated in FIG. 18). Also, in FIG. 4, the dimension of the diaphragm panel 14 is similar to that illustrated in FIG. 18, that is, 72 (mm) in height×51 (mm) in width. Also, in the present invention, the diaphragm panel 14 is preferably bendable, and therefore is 125 (μm) in thickness. As illustrated in FIG. 4, it can be observed that the characteristics of the loudspeaker system according to Embodiment 1 are such that a sound pressure level in the bass range is higher, compared with those of the conventional loudspeaker system. Therefore, the loudspeaker system according to the present invention can easily improve the sound pressure level in the bass range by selecting the diaphragm panel 14 to have a low stiffness.

Figure 5:
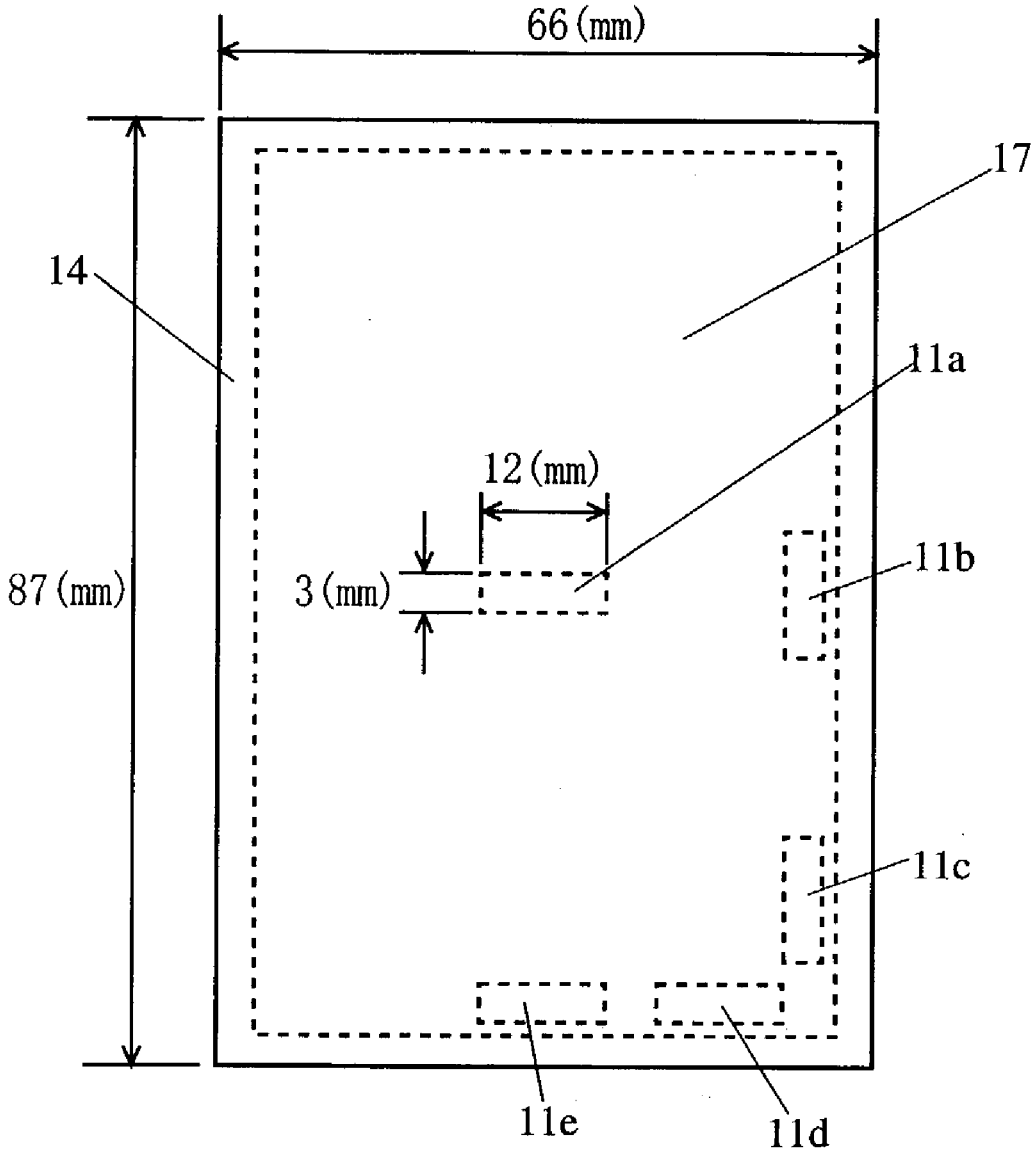
FIG. 5 is an illustration showing a board having a plurality of acoustic apertures.
Figure 6A:
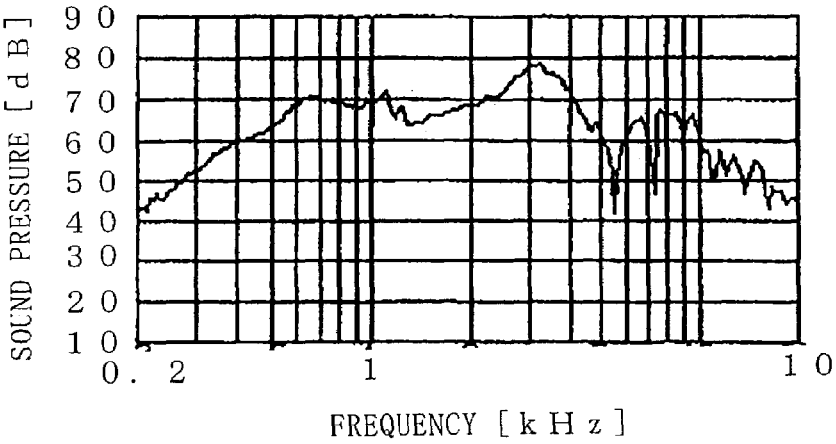
FIGS. 6A, 6B, and 6C are illustrations showing sound pressure frequency characteristics of the loudspeaker system observed when the acoustic apertures are provided at different locations.
Figure 6B:
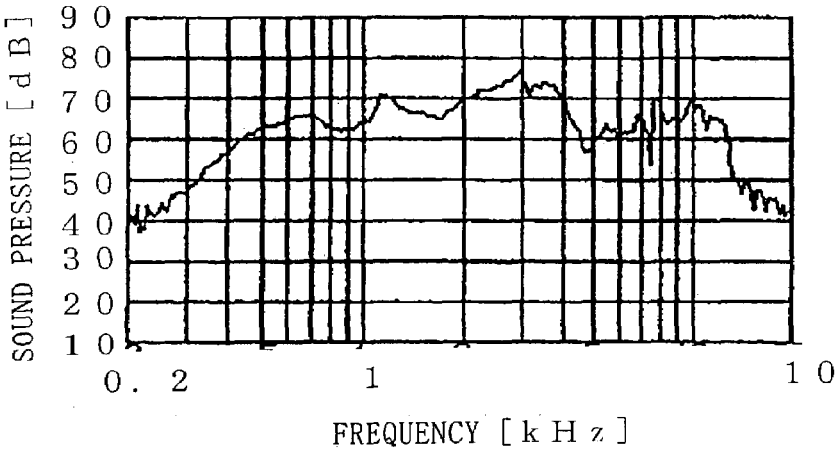
Figure 6C:
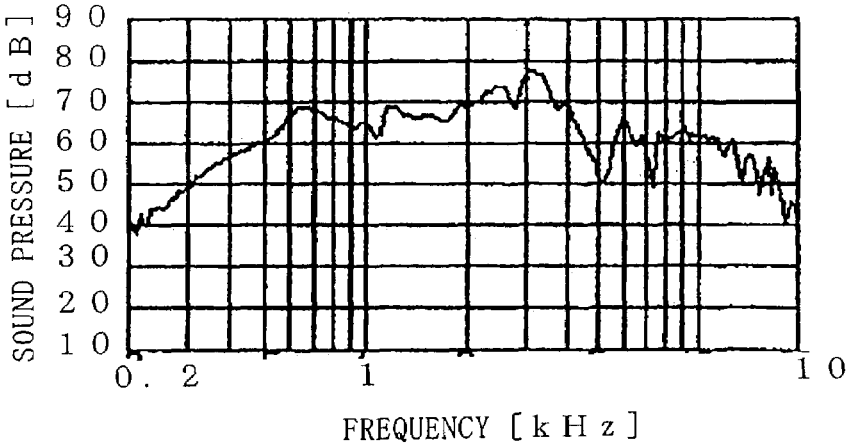

The relationship between the location of the acoustic aperture 11 on the board 10 and the sound pressure characteristics is now described with reference to FIGS. 5 and 6A through 6C. FIG. 5 is an illustration showing a board having a plurality of acoustic apertures. A board 17 illustrated in FIG. 5 is provided with acoustic apertures 11*a* to 11*e*. Only one of these acoustic apertures 11*a* to 11*e* is provided with the electromechanical acoustic transducer 12, while the others are closed and not in use. FIGS. 6A, 6B, and 6C are illustrations showing sound pressure frequency characteristics of the loudspeaker system measured along with changes of the acoustic aperture to be provided with the electromechanical acoustic transducer 12. In the descriptions of FIGS. 5, and 6A through 6C, an electrodynamic loudspeaker having a diameter of ϕ16 (mm) is exemplarily used as the electromechanical acoustic transducer 12. Also, as the diaphragm panel 14, a transparent PET material is exemplarily used having 87 (mm) in height×66 (mm) in width×0.188 (mm) in thickness. Furthermore, every acoustic aperture 11 is a rectangle having 3 (mm) in height×12 (mm) in width. FIGS. 6A through 6C each illustrate the measurement results of the sound pressure frequency characteristics obtained by placing a microphone at a location 0.1 (m) away from the center of the diaphragm panel 14, and applying a power input of 0.1 (W) to the electromechanical acoustic transducer 12.

FIG. 6A is an illustration showing the sound pressure frequency characteristics measured when the acoustic aperture 11*a* is provided with the electromechanical acoustic transducer 12 while the other acoustic apertures are closed. Similarly, FIG. 6B is an illustration showing the sound pressure frequency characteristics measured when the acoustic aperture 11*b* is provided with the electromechanical acoustic transducer 12 while the others are closed. FIG. 6C is an illustration showing the sound pressure frequency characteristics measured when the acoustic aperture 11*e* is provided with the electromechanical acoustic transducer 12 while the others are closed. As evident from FIGS. 6A through 6C, the sound pressure frequency characteristics are little influenced depending on which acoustic aperture is provided with the electromechanical acoustic transducer 12. The same goes for a case, although not shown, in which the acoustic aperture 11*c* or 11*d* is used. As such, in the sound-driving scheme as in the present invention, the sound pressure is used for acoustically driving the diaphragm panel 14. Therefore, whichever the acoustic aperture on the board 10 is used, the diaphragm panel 14 can be similarly driven. On the other hand, in the driving scheme with a transducer directly mounted on a diaphragm panel, the sound frequency characteristics are greatly varied depending on where the transducer is mounted. This disadvantageously limits the mounting location of the transducer. Unlike this, in the loudspeaker system according to the present invention, the electromechanical acoustic transducer 12 can be mounted anywhere on the board 10 so as to cover an acoustic aperture. This increases design flexibility and versatility of the loudspeaker system.

Furthermore, according to Embodiment 1, the diaphragm panel 14 and the board 10 are made of a transparent material. Therefore, the diaphragm panel 14 and board 10 do not interfere with a background of the loudspeaker system. Such a visually unobtrusive loudspeaker system can increase its versatility of usage. Specific application examples of the unobtrusive loudspeaker system are described further below in Embodiments 3 and 4.

Still further, the loudspeaker system, such as the conventional one, having the frame (board) and the diaphragm panel joined together by a suspension is highly complicated in configuration. Therefore, it is very difficult to make the loudspeaker system transparent. More specifically, since a plurality of materials have to be jointed together by an adhesive, it is difficult to make the rims of the board and the diaphragm panel transparent. By contrast, in the present invention, the configuration of the loudspeaker system can be simplified without the use of a suspension. Thus, a visually unobtrusive loudspeaker system can be easily achieved.

Embodiment 2

Figure 7A:
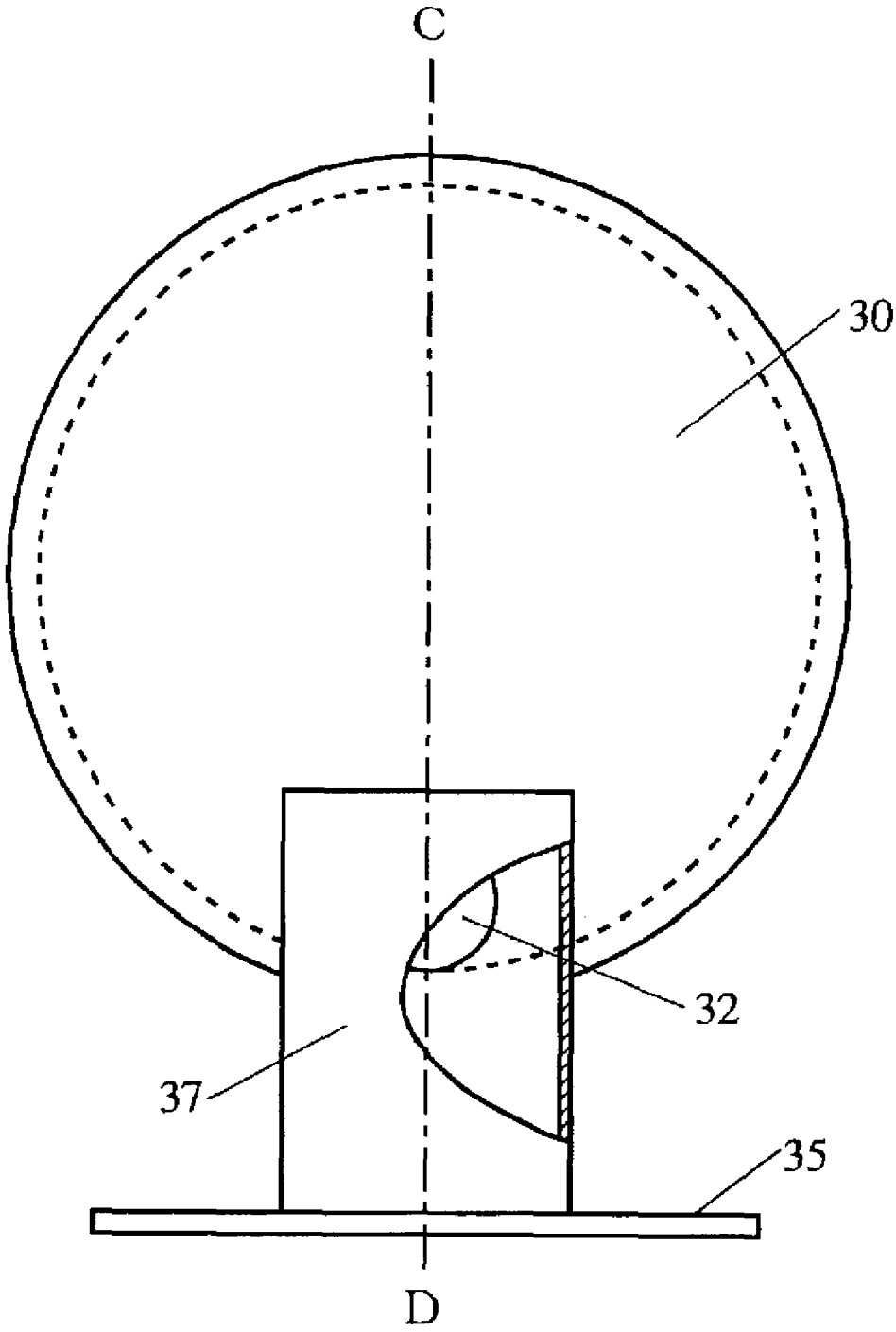
FIGS. 7A and 7B are illustrations each showing the configuration of a loudspeaker system according to Embodiment 2 of the present invention.
Figure 7B:
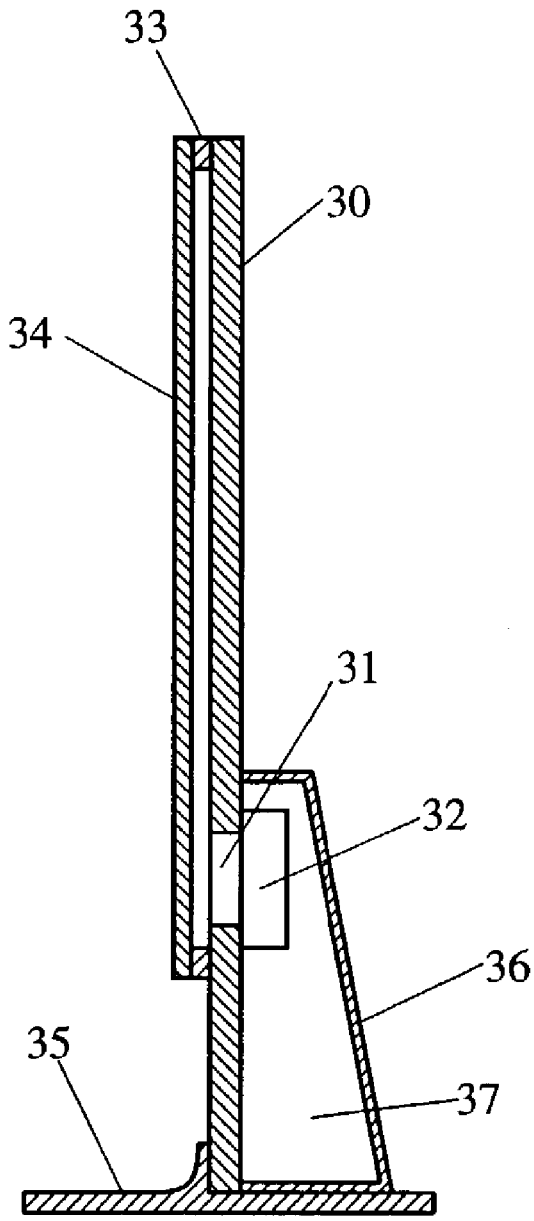

A loudspeaker system according to Embodiment 2 is described below with reference to FIGS. 7A and 7B. FIGS. 7A and 7B are illustrations each showing the configuration of the loudspeaker system according to Embodiment 2 of the present invention. Here, FIG. 7A is a rear view of the loudspeaker system. FIG. 7B is a view of the loudspeaker system denoted by line C–D in FIG. 7A. In FIGS. 7A and 7B, 30 denotes a board. 31 denotes an acoustic aperture provided on the board 30. 32 denotes an electromechanical acoustic transducer attached to the board 30 so as to cover the acoustic aperture 31. 33 denotes a spacer provided on the outer rim of the board 30. 34 is a diaphragm panel attached to the spacer 33. 35 is a base that supports the board 30. 36 denotes a cabinet provided on the back of the electromechanical acoustic transducer 32.

In the loudspeaker system according to Embodiment 2, a difference in configuration from the loudspeaker system according to Embodiment 1 is that the board 30 and the diaphragm panel 34 have a circular shape, and that the cabinet 36 is further provided. The cabinet 36 forms an enclosed space 37 on the back of the electromechanical acoustic transducer 32 (opposed to the acoustic aperture 31). Other than the above difference, the loudspeaker system according to Embodiment 2 is similar in configuration to that according to Embodiment 1. Therefore, also in Embodiment 2, the loudspeaker system can be simplified in configuration compared with the conventional loudspeaker system.

In Embodiment 2, as with Embodiment 1, an electrical signal is applied to the electromechanical acoustic transducer 32 to cause the diaphragm panel 34 to vibrate. In Embodiment 2, the circular shapes of the board 30 and the diaphragm panel 34 do not have any influence on the above operation. In the present invention, the shapes of the board 30 and the diaphragm panel 34 may be any. That is, the present invention discloses a scheme for driving the diaphragm panel 34 by sound pressure emitted from the electromechanical acoustic transducer 32. Therefore, any arbitrary shape, such as semicircles, ellipses, or polygons, will suffice for the board 30 and the diaphragm panel 34 to perform audio reproduction. This increases design flexibility of the loudspeaker system compared with the scheme of directly driving the diaphragm panel by the transducer.

In the loudspeaker system according to Embodiment 2, a difference from the loudspeaker system according to Embodiment 1 lies in the cabinet 36. Sound produced from the back of the electromechanical acoustic transducer 32 is emitted into the space 37 formed by the cabinet 36. Therefore, the sound from the back of the electromechanical acoustic transducer 32 does not go out of the space 37. With this, it is possible to prevent cancellation of the sound from the diaphragm panel 34 and the opposite-phase sound from the back of the electromechanical acoustic transducer 32. Thus, the sound pressure level in the bass range can be particularly improved.

Note that, in Embodiment 2, the cabinet 36 is not necessarily required. Also, such a cabinet can be provided to the loudspeaker systems according to Embodiments 1 and 5, which will be described further below.

Embodiment 3

Figure 8:
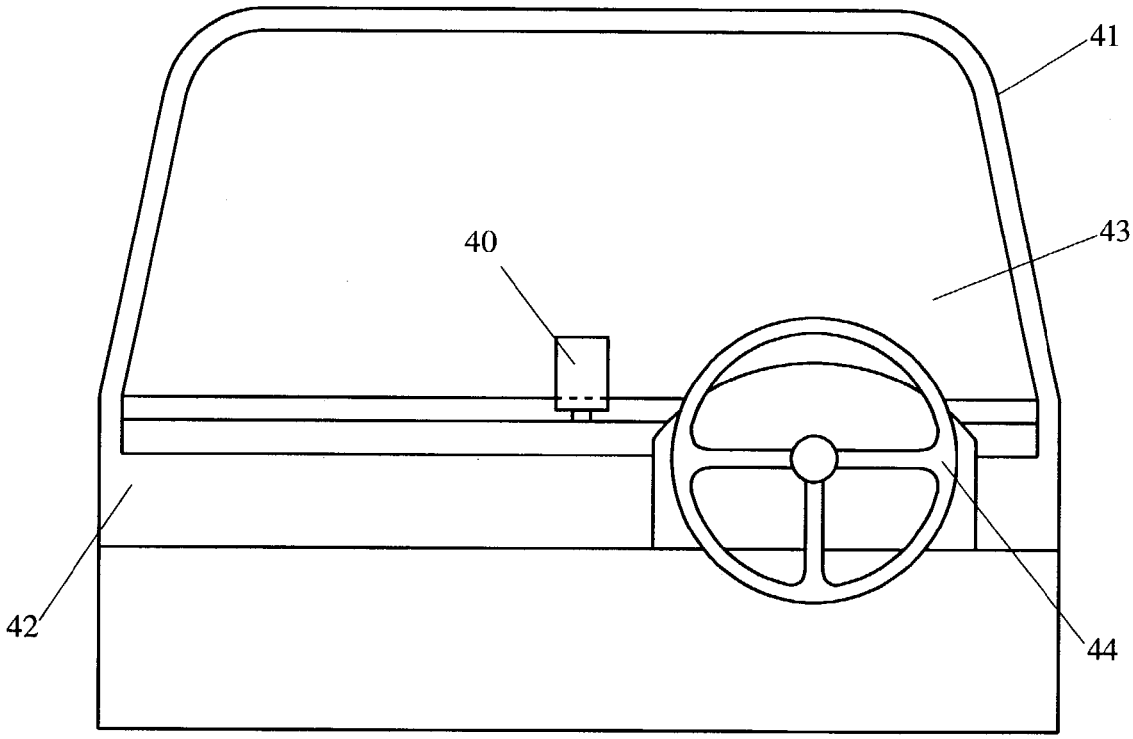
FIG. 8 is an illustration showing an exemplary case in which a loudspeaker system according to Embodiment 3 is mounted inside a vehicle.

A loudspeaker system according to Embodiment 3 is described below with reference to FIGS. 8 and 9. FIG. 8 is an illustration showing an exemplary case in which the loudspeaker system according to Embodiment 3 is mounted inside a vehicle. In FIG. 8, 40 denotes the loudspeaker system according to Embodiment 3. 41 denotes a vehicle body. 42 denotes a dashboard. 43 denotes a windshield. 44 denotes a steering wheel. The configuration of the loudspeaker system according to Embodiment 3 is now described below.

Figure 9:
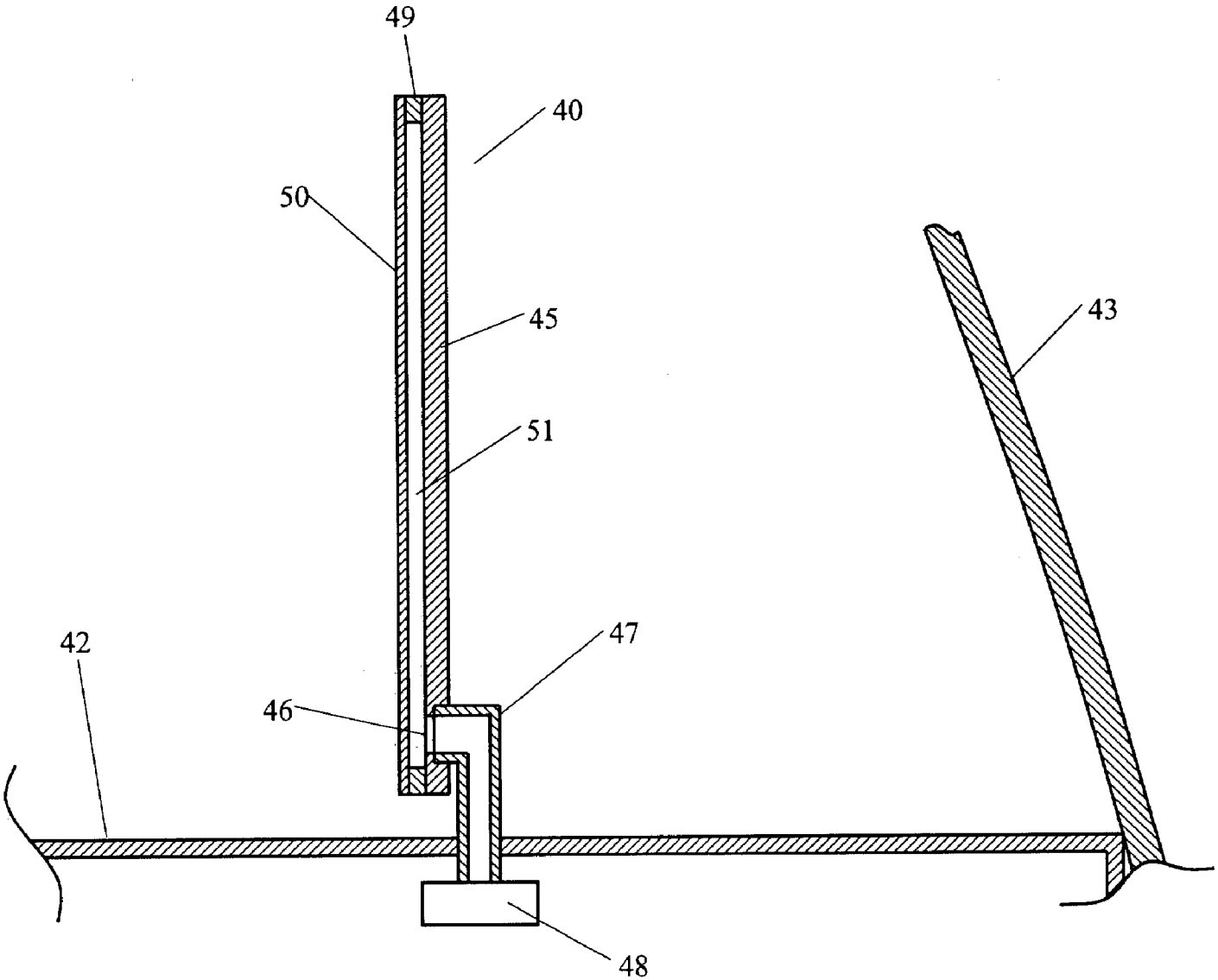
FIG. 9 is a section view of a state in which a loudspeaker system 40 illustrated in FIG. 8 is mounted onto a vehicle body.

FIG. 9 is a section view of a state in which the loudspeaker system 40 illustrated in FIG. 8 is mounted onto the vehicle body. In FIG. 9, 45 denotes aboard 46 denotes an acoustic aperture provided on the board 45. 47 denotes an acoustic pipe attached to the board 45 so as to cover the acoustic aperture 46. 48 denotes an electromechanical acoustic transducer on which the acoustic pipe 47 is mounted. 49 denotes a spacer provided on the outer rim of the board 45. 50 denotes a diaphragm panel attached to the spacer 49.

In Embodiment 3, the loudspeaker system 40 is different from that according to Embodiment 1 in that the acoustic pipe 47 is further provided for connecting the acoustic aperture 46 on the board 45 and the electromechanical acoustic transducer 48 together. That is, with the acoustic pipe 47 connecting the board 45 and the electromechanical acoustic transducer 48 together so as to cover the acoustic aperture 46, the electromechanical acoustic transducer 48 is placed separately from the board 45 and the diaphragm panel 50. Other than the above difference, the loudspeaker system 40 is similar to that according to Embodiment 1. Furthermore, in the loudspeaker system 40, the acoustic pipe 47 is penetratingly mounted on the dashboard 42. In the above-structured loudspeaker system 40, sound from the electromechanical acoustic transducer 48 is led via the acoustic pipe 47 to the acoustic aperture 46, and is then transferred to a space 51 formed by the board 45, the diaphragm panel 50, and the spacer 49. Note that the operation of the loudspeaker system according to Embodiment 3 is similar to that according to Embodiment 1, except for the above, that is, the electromechanical acoustic transducer 48 emits sound via the acoustic pipe 47 to the acoustic aperture 46 and then to the space 51.

As described above, according to Embodiment 3, the electromechanical acoustic transducer 48, which is difficult to be made transparent, can be hidden inside the vehicle body. Furthermore, as with Embodiment 1, the board 45, the spacer 49, and the diaphragm panel 50 are made of a transparent material. Therefore, if the acoustic pipe 47 is also made of a transparent material, such as polycarbonate or acrylic, it is possible to achieve a loudspeaker system which is almost transparent to a user's eyes and therefore is not obtrusive to the user's view. Such a transparent loudspeaker system is particularly suitable for vehicles in view of driver's safety, since the loudspeaker system mounted on the dashboard or the like does not obstruct a view ahead of the vehicle.

In Embodiment 3, only a single loudspeaker system 40 is mounted at the center of the upper surface of the dashboard 42. Alternatively, a plurality of loudspeaker systems 40 can be further mounted on right and left portions thereof for multi-channel reproduction such as stereo reproduction, together with the loudspeaker system 40 at the center being used as a center channel. Furthermore, the mounting location of the loudspeaker system 40 is not restricted to the dashboard 42, but can be anywhere on the vehicle so as to achieve the effects of Embodiment 3.

Embodiment 4

The configuration of a loudspeaker system according to Embodiment 4 is described below with reference to FIGS. 10 and 11. FIG. 10 is an illustration showing the configuration of the loudspeaker system according to Embodiment 4. In FIG. 10, 60 denotes a wall (serving as a board of the loudspeaker system) that composes a building. 61 denotes an acoustic aperture provided on the wall 60. 62 denotes an acoustic pipe penetratingly attached to the wall 60 so as to cover the acoustic aperture 61. 63 denotes an electromechanical acoustic transducer. 64 denotes a spacer mounted on the wall 60. 65 denotes a diaphragm panel attached to the spacer 64.

In the loudspeaker system according to Embodiment 4, a difference in configuration from the loudspeaker system according to Embodiment 1 is that the wall 60 of a room of the building serves as a board of the loudspeaker system. That is, the board of the loudspeaker system according to Embodiment 4 also serves as a structural component of the building. Note that the spacer 64 and the diaphragm panel 65 are similar to those in Embodiment 1. Furthermore, as with the other embodiments described above, the wall 60 has to have a stiffness higher than that of the diaphragm panel 65.

Figure 11:
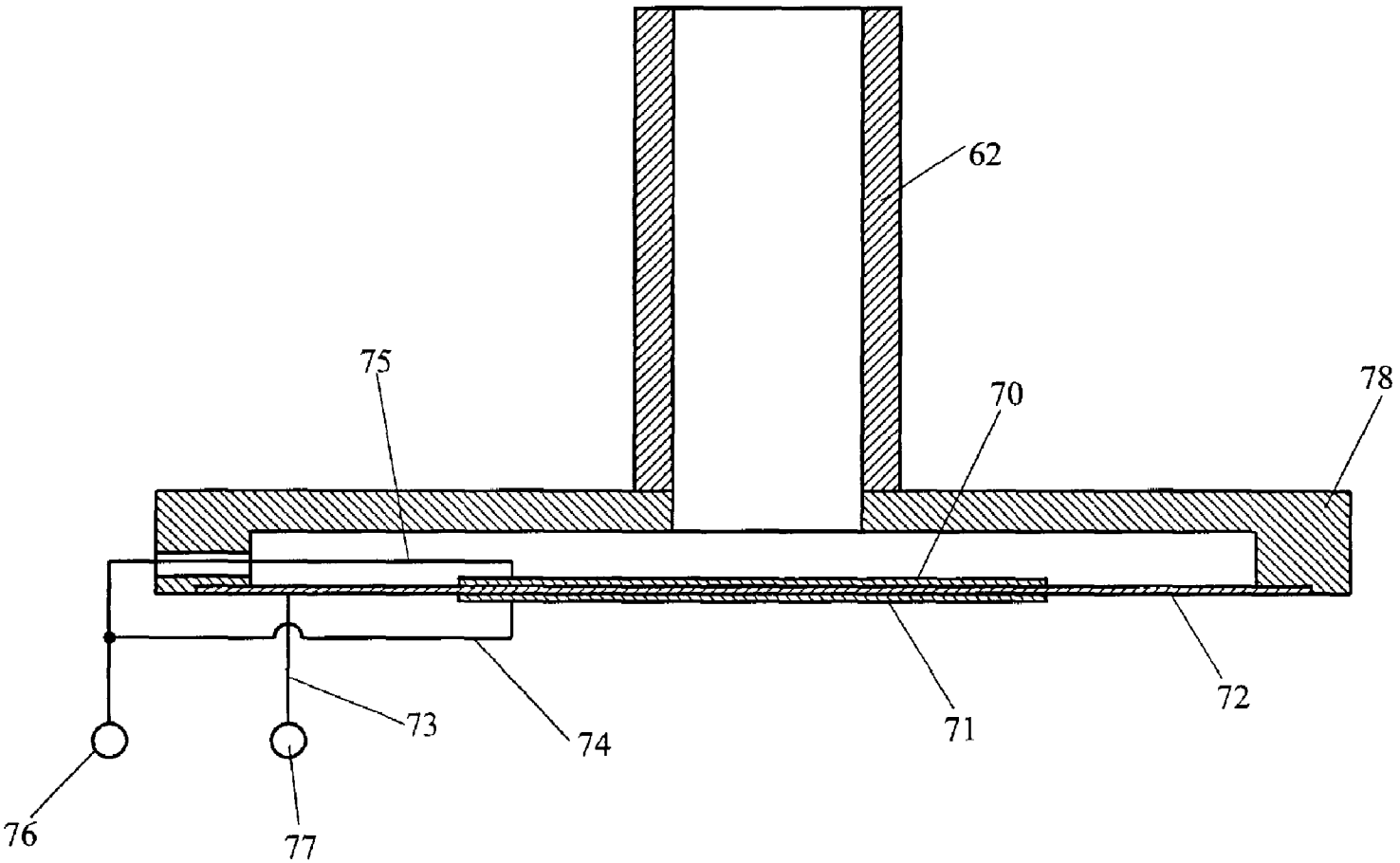
FIG. 11 is a section view of a piezoelectric loudspeaker, which is one example of an electromechanical acoustic transducer 63 illustrated in FIG. 10.

FIG. 11 is a section view of a piezoelectric loudspeaker, which is one example of the electromechanical acoustic transducer 63 illustrated in FIG. 10. In FIG. 11, 70 and 71 denote piezoelectric elements. 72 denotes an intermediate electrode having the piezoelectric elements attached on both sides. 73 denotes a lead connected to the intermediate electrode 72 for receiving electrical input. 74 denotes a lead connected to the piezoelectric element 71. 75 is a lead connected to the piezoelectric element 70. 78 denotes a loudspeaker frame attached to the outer rim of the intermediate electrode 72. The intermediate electrode 72 is made of a conductive material, such as phosphor bronze or stainless steel. The lead is connected to an input terminal 77, while the leads 74 and 75 are connected to an input terminal 76. The loudspeaker frame 78 is jointed to the acoustic pipe 62.

In the loudspeaker system according Embodiment 4, a difference in operation from the loudspeaker system according to Embodiment 3 lies in the operation of the piezoelectric-type electromechanical acoustic transducer 63. In the electromechanical acoustic transducer 63, when electrical signals are applied to the input terminals 76 and 77, the piezoelectric elements 70 and 71 attached to both sides of the intermediate electrode 72 are flexed to be vibrated. With this, the intermediate electrode 72 and the piezoelectric elements 70 and 71 emit sound. Other than the above operation, the operation of the loudspeaker system according to Embodiment 4 is similar to that according to Embodiment 3.

As described above, according to Embodiment 4, the wall 60, which is a structural component, is used as a board of the loudspeaker system, and the electromechanical acoustic transducer 63 is placed outside the wall 60. With this, the electromechanical acoustic transducer 63 is hidden from the surface of the wall 60. Furthermore, as described in Embodiment 1, the spacer 64 and the diaphragm panel 65 are made of a transparent material. Therefore, according to Embodiment 4, it is possible to achieve a loudspeaker system that is visually unobtrusive to users.

Application examples of the loudspeaker system according to Embodiment 4 are as follows. For example, the loudspeaker system can be mounted on a wall of a room for use as a loudspeaker for DVD multi-channel reproduction. Also, the wall on the back of the transparent diaphragm panel 65 is attached with a poster or picture, thereby giving users a feeling as if sound is coming from the poster or the picture. Such a loudspeaker system is suitable not only for home use but also for exhibition use. Furthermore, the loudspeaker system according to Embodiment 4 can use a glass surface of a show window, a vehicle body, furniture, an electrical appliance, etc., as the board of the loudspeaker system.

Embodiment 5

Figure 12A:
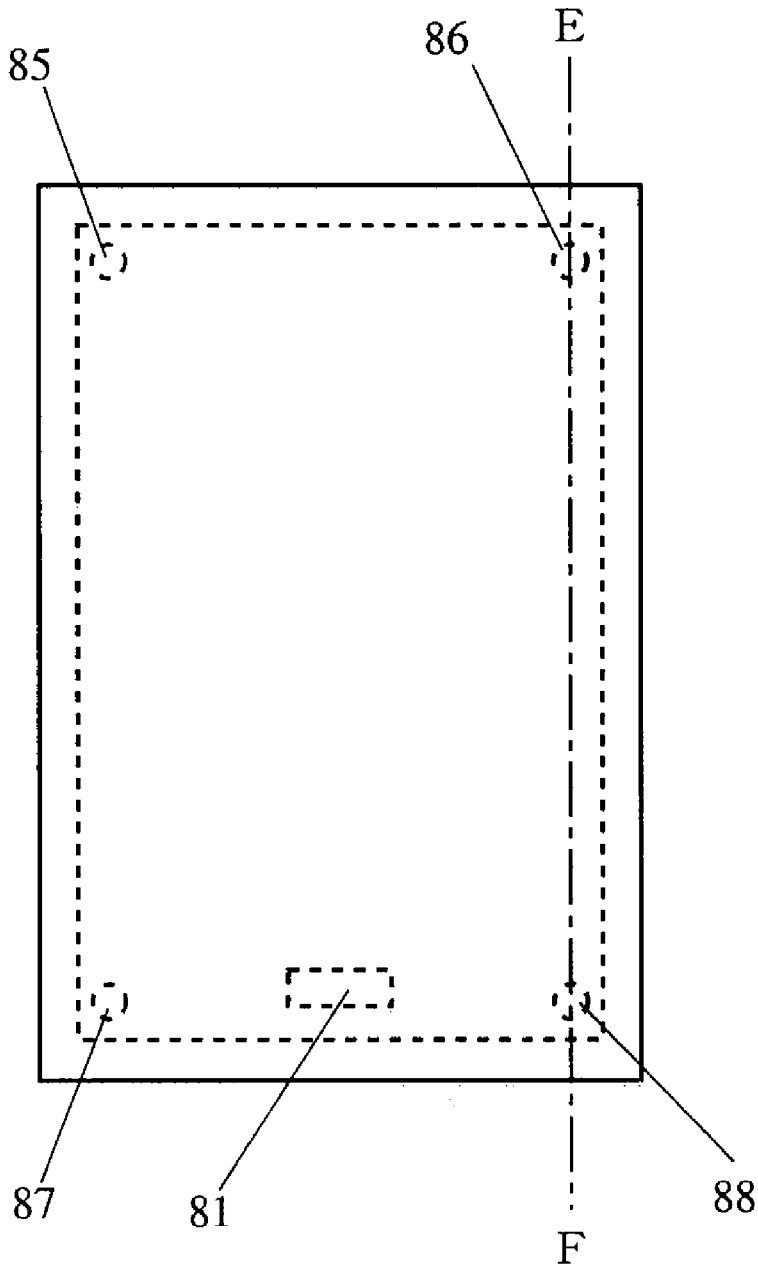
FIGS. 12A and 12B are illustrations each showing the configuration of a loudspeaker system according to Embodiment 5 of the present invention.
Figure 12B:
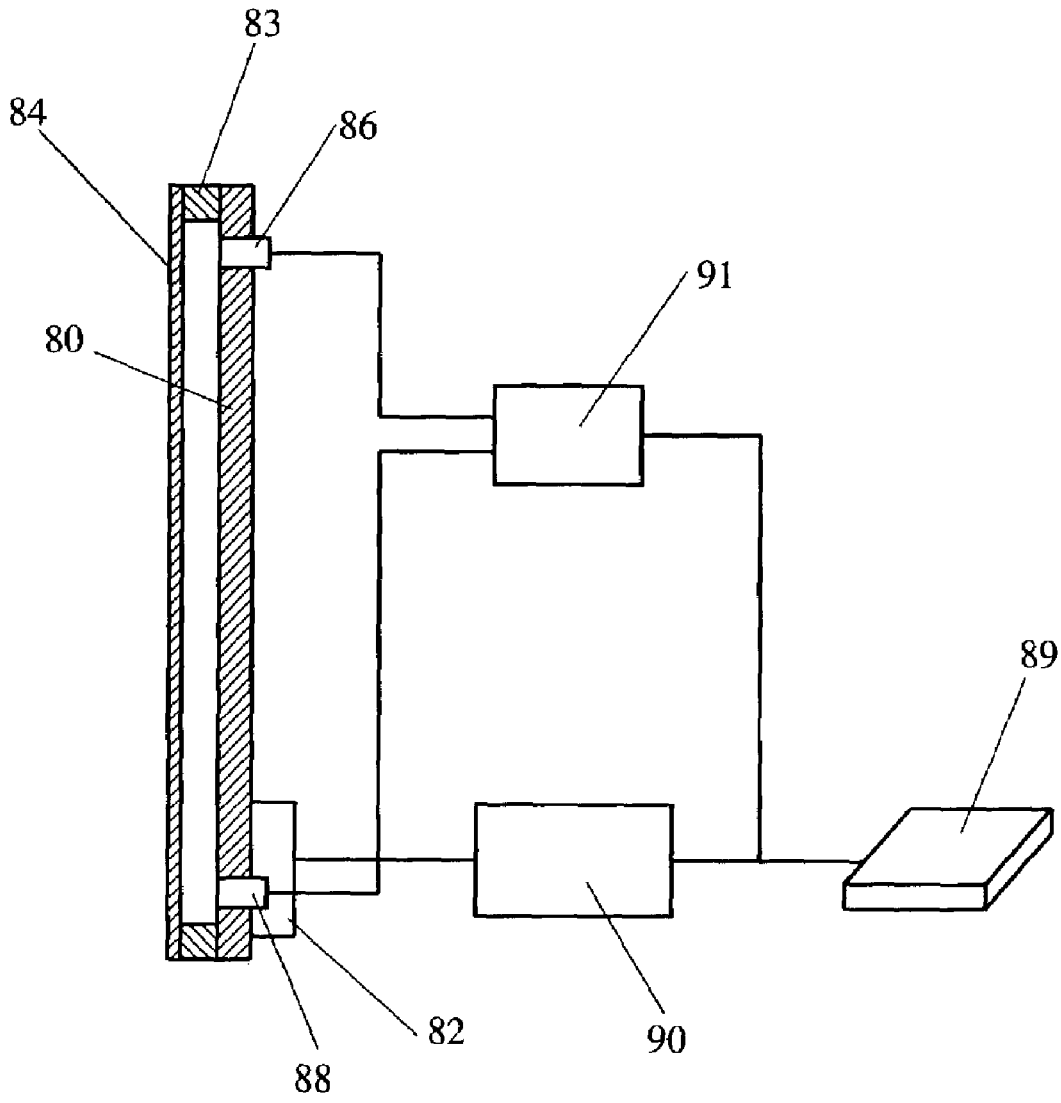

A loudspeaker system according to Embodiment 5 is described below with reference to FIGS. 12A and 12B. FIGS. 12A and 12B are illustrations each showing the configuration of the loudspeaker system according to Embodiment 5 of the present invention. Here, FIG. 12A is a front view of the loudspeaker system. FIG. 12B is a view the loudspeaker denoted by line E–F in FIG. 12A. In FIGS. 12A and 12B, 80 denotes a board. 81 denotes an acoustic aperture provided on the board 81. 82 denotes an electromechanical acoustic transducer attached to the board 81 so as to cover the acoustic aperture 81. 83 denotes a spacer provided to the outer rim of the board 80. 84 denotes a diaphragm panel attached to the spacer 83. 85, 86, 87, and 88 denote light-emitting diodes provided at the four corners of the board 80. 89 denotes a CD player. 90 denotes an amplifier connected to the CD player 89 and the electromechanical acoustic transducer 82. 91 denotes a signal controller connected to the CD player 89 and the light-emitting diodes 85 through 88.

The operation of the above-structured loudspeaker system is described below. A music signal reproduced by the CD player 89 is amplified by the amplifier 90, and is then applied to the electromechanical acoustic transducer 82. Based on the applied music signal, the electromechanical acoustic transducer 82 emits sound, which acoustically drives the diaphragm panel 84 to produce sound. This operation is similar to that in Embodiment 1.

The loudspeaker system according to Embodiment 5 is different from that according to Embodiment 1 in that the light-emitting diodes 85 through 88, which are merely an example of light emitting means, and the signal controller 91 are further provided. Supplied with a music signal by the CD player 89, the signal controller 91 applies a signal corresponding to the music signal to the light-emitting diodes 85 through 88. With this, it is possible to achieve a loudspeaker system that emits light in accordance with the music signal. Such a loudspeaker system can provide users with visual enjoyment. Light-emitting patterns and brightness of the light-emitting diodes 85 through 88 may be varied in accordance with the magnitude and/or frequency of the music signal. Also, the signal controller 91 may apply different signals to the light-emitting diodes 85 through 88. This can achieve a loudspeaker system with light-emitting diodes illuminating with different brightness levels in accordance with the music signal.

The diaphragm panel 84 may be translucent. If the diaphragm panel 84 is transparent, rays of light emitted from the light-emitting diodes 85 through 88 merely pass through the diaphragm panel 84. If the diaphragm panel 84 is translucent, however, the rays of light are diffused by the diaphragm panel 84. With this, attractive lighting effects can be expected. Furthermore, rays of light emitted from the light-emitting diodes do not necessarily have a single color, but may have different colors. Still further, an arbitrary number of light-emitting diodes can be placed on arbitrary locations of the board 80. For example, the light-emitting diodes can be located within the board 80 to achieve an effect that the board 80 itself seems to illuminate.

As described in the foregoing, according to the present invention, no suspension is required. Therefore, it is possible to achieve a sound-driving loudspeaker system with a simple configuration. Moreover, the diaphragm panel is vibrated not by a piston action but by flexion. With this, it is possible to easily achieve a loudspeaker system with an improved sound pressure level in the bass range.

The electromechanical acoustic transducer 12 is exemplarily implemented by an electrodynamic loudspeaker in Embodiment 1 and by a piezoelectric loudspeaker in Embodiment 4. Here, in Embodiments 1 through 5, the electromechanical acoustic transducer may be any as long as it causes the diaphragm panel to emit sound. Also, the conversional scheme used in the electromechanical acoustic transducer 12 may be any, such as of an electromagnetic type, piezoelectric type, or electrostatic type.

Figure 13:
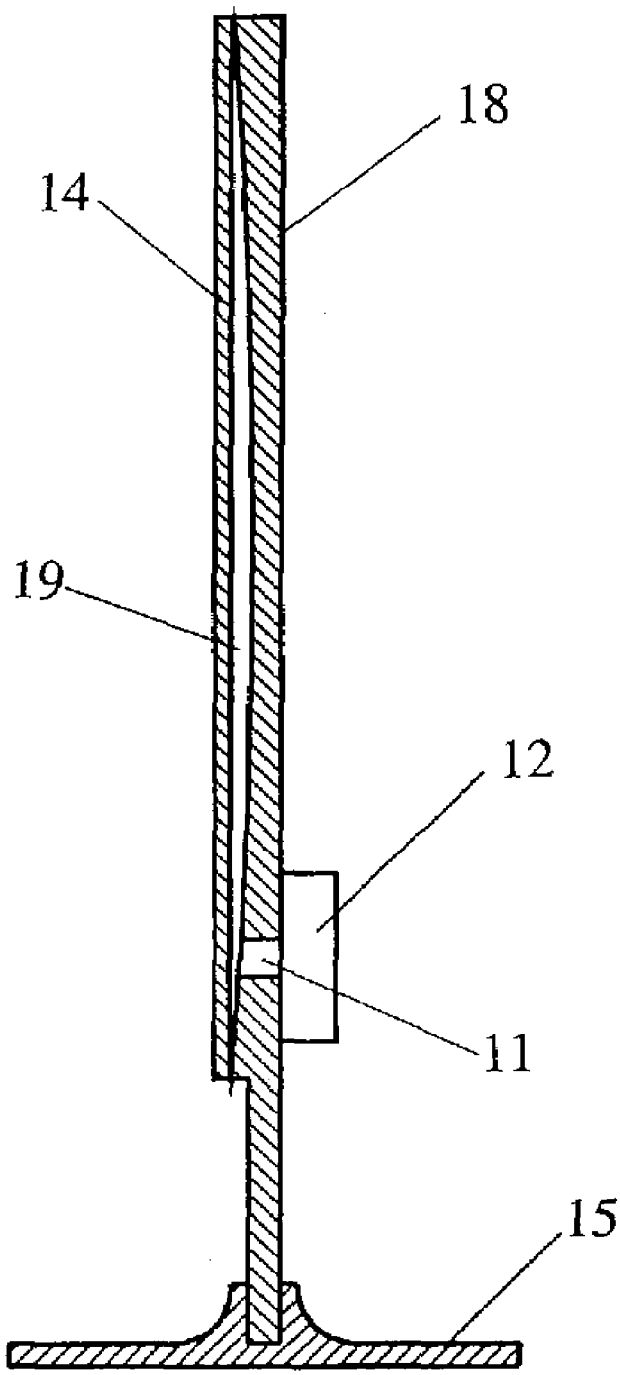
FIG. 13 is an illustration showing an exemplary modification of a board used in the loudspeaker according to the present invention.
Figure 14:
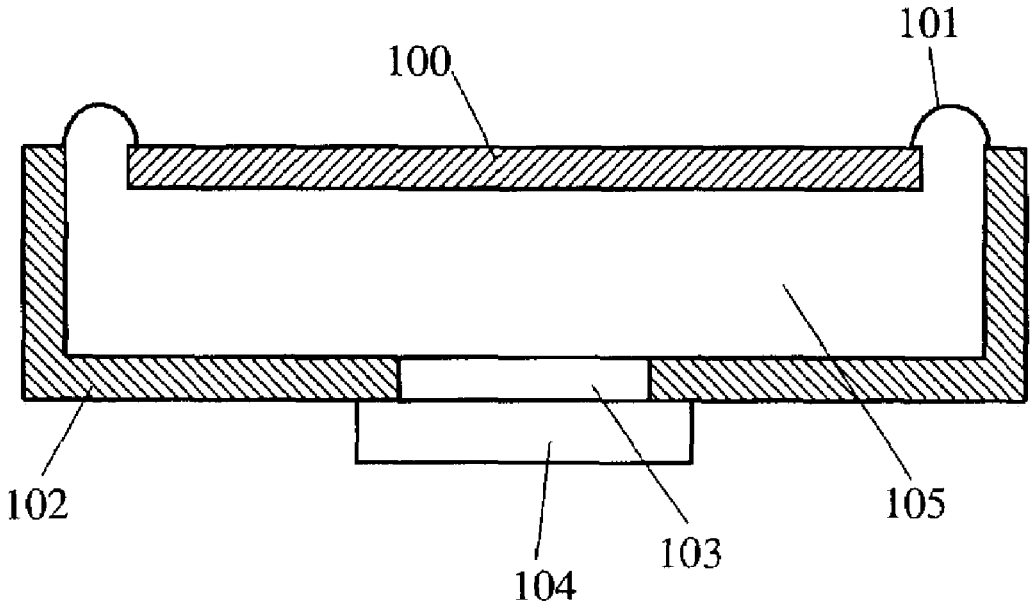
FIG. 14 PRIOR ART
FIG. 14 is an illustration showing a basic configuration of a conventional loudspeaker system using the sound-driving scheme.

In Embodiments 1 through 5, the board and the outer rim portion of the diaphragm panel are fixed together via the spacer to form a space (the space 16 illustrated in FIG. 1B, for example) for acoustically driving the diaphragm panel. Alternatively, the board can have any structure as long as the board and the diaphragm panel form the above-mentioned space. One example of the structure of the board is illustrated in FIG. 13. FIG. 13 is an illustration showing an exemplary modification of the board used in the loudspeaker according to the present invention. Note that, in FIG. 13, components similar in structure to those in FIG. 1B are provided with the same reference numerals. In FIG. 13, a plate-like board 18 having its center portion bowed inward is used, with the diaphragm panel 14 directly jointed to the outer rim of the board 18. As such, the board and the diaphragm panel can be directly fixed together without a spacer. In this case, the bowed center portion forms a space 19 for acoustically driving the diaphragm panel 14. Moreover, the space can be formed by a bonding layer for bonding a flat board and a flat diaphragm panel.

Still further, in Embodiments 1 through 5, the board and the diaphragm panel both have a flat surface, but both can have a curved surface. Even in this case, the diaphragm panel can be vibrated as long as the board and the diaphragm panel form a space. The same goes for a case in which either one of the board and the diaphragm panel has a curved surface. Similarly, the loudspeaker system according to the present invention can be achieved even if the board has a complex shape.

Still further, in Embodiments 1 through 5, the diaphragm panel is implemented by a PET film. This is not meant to be restrictive. The diaphragm panel can be made of any material that has a stiffness lower than that of the board. For example, the diaphragm panel can be made of paper. This is particularly suitable for Embodiment 4. With a paper poster or photograph being used as the diaphragm panel, it is possible to achieve a loudspeaker system in which sound is emitted from the poster or photograph itself. In this case, if such a diaphragm panel is configured to be removable from the board, the user can change the poster or photograph used as the diaphragm panel according to his or her preferences. Conversely, the diaphragm panel may be fixed to the board with a predetermined tension.

While the invention has been described in detail, the foregoing description is in all aspects illustrative and not restrictive. It is understood that numerous other modifications and variations can be devised without departing from the scope of the invention.

What is claimed is:

1. A loudspeaker system comprising:

a board for forming a space for sound emission;

an electromechanical acoustic transducer connected to the board for emitting sound into the space for the sound emission; and a diaphragm panel having an outer rim portion fixed to the board in a manner to form the space with the board, having a stiffness lower than a stiffness of the board, and being flexed to be vibrated by energy of the sound emitted from the electromechanical acoustic transducer into the space to externally output the sound, wherein the diaphragm panel is made of a transparent material, and wherein the board is made of a transparent material.

2. The loudspeaker system according to claim 1, further comprising light-emitting means, mounted onto the board and/or the diaphragm panel, for emitting light in response to an input signal supplied to the electromechanical acoustic transducer.

3. The loudspeaker system according to claim 1, further comprising a spacer, wherein the outer rim portion of the diaphragm panel is fixed to the board via the spacer.

4. The loudspeaker system according to claim 1, wherein the board has an acoustic aperture, and the electromechanical acoustic transducer is positioned opposed to the diaphragm panel to allow sound to be emitted from the acoustic aperture into the space.

5. The loudspeaker system according to claim 1, further comprising an acoustic pipe for connecting the board and the electromechanical acoustic transducer together, wherein the board has an acoustic aperture at a portion connected to the acoustic pipe, and the electromechanical acoustic transducer is operable to emit sound from the acoustic aperture through the acoustic pipe into the space.

6. The loudspeaker system according to claim 1, further comprising a cabinet for forming an enclosed space at a back of the electromechanical acoustic transducer.

* * * * *